US008898833B2

(12) United States Patent
Coates

(10) Patent No.: US 8,898,833 B2
(45) Date of Patent: Dec. 2, 2014

(54) INFANT AND PREEMIE SWADDLING WRAPS WITH NECK PADDING

(71) Applicant: Tailored Technologies, Inc., Winston-Salem, NC (US)

(72) Inventor: Fredrica V. Coates, Winston-Salem, NC (US)

(73) Assignee: Tailored Technologies, Inc., Winston-Salem, NC (US)

( * ) Notice: Subject to any disclaimer, the term of this patent is extended or adjusted under 35 U.S.C. 154(b) by 63 days.

(21) Appl. No.: 13/923,716

(22) Filed: Jun. 21, 2013

(65) Prior Publication Data

US 2014/0020177 A1 Jan. 23, 2014

Related U.S. Application Data

(63) Continuation-in-part of application No. 13/551,205, filed on Jul. 17, 2012, now Pat. No. 8,667,631.

(51) Int. Cl.
*A41B 13/06* (2006.01)

(52) U.S. Cl.
USPC ..... 5/494; 5/655; 5/485; 5/413 R; 2/69.5

(58) Field of Classification Search
USPC ..... 5/655, 494, 498; 2/69.5
See application file for complete search history.

(56) References Cited

U.S. PATENT DOCUMENTS

| | | | | |
|---|---|---|---|---|
| 2003/0131411 | A1 * | 7/2003 | Gibson | 5/482 |
| 2004/0139527 | A1 * | 7/2004 | Damir et al. | 2/83 |
| 2010/0275373 | A1 * | 11/2010 | Kaplan et al. | 5/494 |
| 2011/0231993 | A1 * | 9/2011 | Schmid et al. | 5/494 |

FOREIGN PATENT DOCUMENTS

WO WO 2006055010 A1 * 5/2006

* cited by examiner

*Primary Examiner* — Brittany Wilson
(74) *Attorney, Agent, or Firm* — Shumaker, Loop & Kendrick, LLP

(57) ABSTRACT

An infant garment including a body for covering an infant and neck padding located within the body and extending from the base of the skull of an infant positioned on the body to the top of the shoulder blades of the infant positioned on the body, and from shoulder-to-shoulder of the infant positioned on the body, wherein the neck padding includes a greater degree of padding than the body.

17 Claims, 24 Drawing Sheets

Fig. 7A
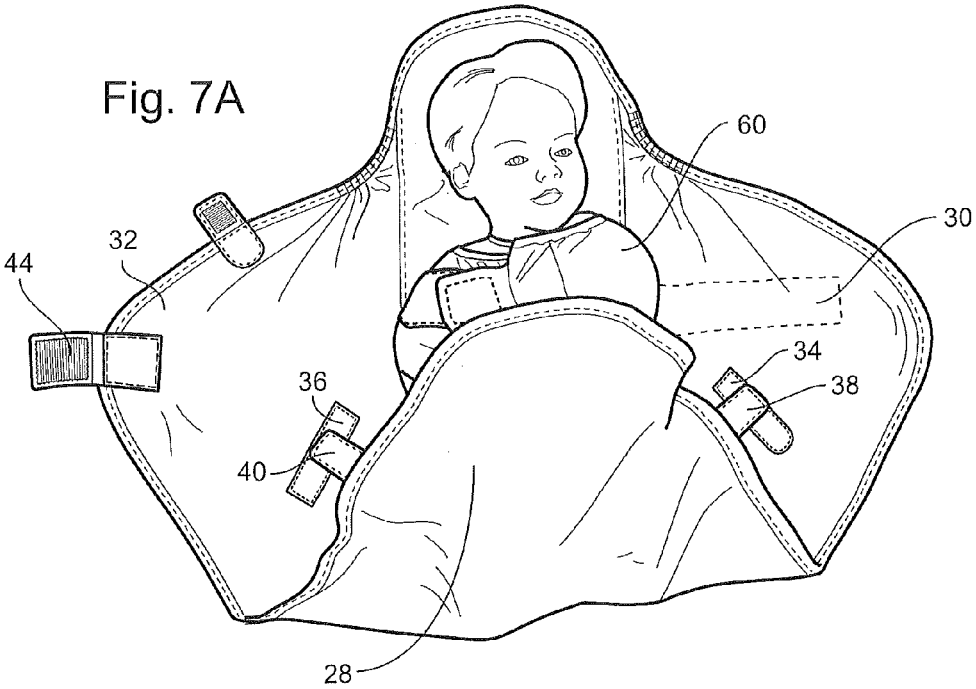
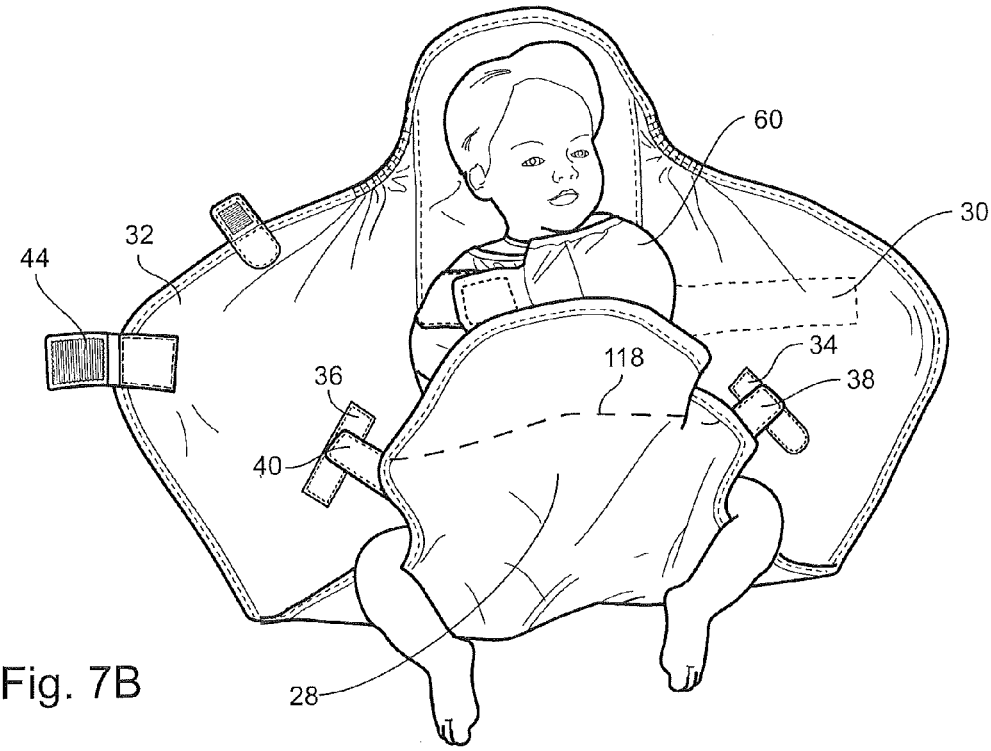
Fig. 7B

INFANT AND PREEMIE SWADDLING WRAPS WITH NECK PADDING

CROSS-REFERENCE TO RELATED APPLICATION

This application is a Continuation-in-Part application (CIP) claiming priority to U.S. application Ser. No. 13/551,205 filed Jul. 17, 2012, the contents of which are incorporated by reference herein.

TECHNICAL FIELD AND BACKGROUND OF THE INVENTION

The present invention relates generally to the field of swaddling wraps for infants and preemies, and more particularly, to swaddling wraps including improved neck padding, as well as an improved fastener design for maintaining the wraps in their folded configuration.

Buntings and hooded towels are well known for providing warmth and comfort to infants, for example, after a bath or generally. Conventional designs typically include a single square or rectangular piece of material having a hood attached thereto centered along one side. The material may be conventional blanket or towel material depending on the intended use of the article.

Square and rectangular material shapes are advantageous to manufacture because of the simplicity of their geometry. This geometry, however, is disadvantageous in that the folds required to adequately cover an infant with a rectangular piece of material results in air gaps and material bunching about the feet and neck of the infant. While air gaps and bunching about the feet makes these wraps more difficult to use and less effective at providing warmth, bunching about the attachment point of the hood is a safety concern because it allows the infant's head to fit further into the hood than is safe and can block the infant's breathing. Therefore, extra care must be taken to ensure that the infant's breathing is unobstructed during wrapping and thereafter.

To overcome the disadvantages of these prior art designs, what is needed is a swaddling wrap that has a geometry that is safer for the infant and more effective at retaining warmth. It would further be desirable for the wrap to better support the infant's head, maintain its folded configuration, and be easier to use.

BRIEF SUMMARY OF THE INVENTION

In one aspect, an infant swaddling wrap is provided herein.

In another aspect, the infant swaddling wrap is folded around an infant for warmth and comfort.

In another aspect, the infant swaddling wrap has a kite-shaped geometry that substantially reduces air gaps and material bunching when folded around the infant.

In another aspect, the infant wrap includes improved fasteners for maintaining the wrap in its folded configuration around the infant.

In another aspect, the fasteners can be high-strength hook-and-loop fasteners with padded and concealed corners and edges.

In another aspect, the infant swaddling wrap includes a padded head-supporting portion.

In another aspect, the infant swaddling wrap includes a padded body-supporting portion.

In another aspect, the padded head and body-supporting portions are connected.

In another aspect, the head and body-supporting portions each include a recess for positioning their respective supported body part therein.

In another aspect, the recess of the head-supporting portion can have a non-circular shape and the recess of the body-supporting portion can have a rectangular shape.

In another aspect, the recess is sewn into the head and body-supporting portions, the sewn portion serving as a visual guide for positioning the head and body.

In another aspect, the head-supporting portion includes a lesser padding thickness about the sides of the head to prevent any blocking of breathing.

In another aspect, the infant swaddling wrap includes elastic sewn into the perimeter of the wrap at the intersection of the head-supporting portion and wings.

In another aspect, the infant swaddling wrap include a removable pouch that removably attaches to the body-supporting portion.

In another aspect, the removable pouch can wrap and fasten around the torso and arms of the infant while leaving the legs exposed.

In another aspect, a preemie swaddling wrap is provided herein.

In another aspect, the preemie swaddling wrap is folded around a preemie for warmth and comfort.

In another aspect, the preemie swaddling wrap has a kite-shaped geometry that substantially reduces air gaps and material bunching when folded around the preemie.

In another aspect, the preemie wrap includes improved padded fasteners for maintaining the wrap in its folded configuration and safety.

In another aspect, the preemie swaddling wrap includes a padded head-supporting portion having a lesser padding thickness along its sides for preventing any blocking of breathing.

In another aspect, the preemie swaddling wrap includes a padded body-supporting portion.

In another aspect, the padded head and body-supporting portions are connected.

In another aspect, the head-supporting portion includes a recess for positioning the preemie's head therein.

In another aspect, the recess includes a lesser degree of padding than its surrounding portion.

In another aspect, the recess has a non-cicular shape.

In another aspect, the recess can have an arched top and flat bottom.

In another aspect, the recess is sewn into the head-supporting portion, the sewn portion serving as a visual guide for positioning the head.

In another aspect, the preemie swaddling wrap includes elastic sewn into the perimeter of the wrap at the intersection of the head-supporting portion and wings.

In another aspect, the preemie swaddling wrap includes a plurality of releasable fasteners positioned around the perimeter of the wrap for releasably engaging folded portions of the wrap.

To achieve the foregoing and other aspects and advantages of the present invention, in one embodiment an infant swaddling wrap is provided herein generally including a kite-shaped body defining a head-supporting portion, a bottom flap and opposing left and right wings. In use, the infant is positioned longitudinally aligned along an imaginary line bisecting the wrap. With the infant's head properly positioned within the head-supporting portion in the recess thereof, the bottom flap is folded upward to cover the legs and a portion of the torso. With the bottom flap folded upward, the right wing is folded over the torso and the bottom flap, followed by folding the left wing over the right wing. The wings are maintained in their folded configurations by way of one or more releasably fasteners that releasably engage the wrap material, for example hook-and-loop fasteners. The infant swaddling wrap can be constructed from any material or combination of materials including, but not limited to cotton, flannel, fleece and terry cloth.

Head and body-supporting portions of the wrap preferably include padding for support and comfort. The padding can have lesser and greater degrees of padding around the head so as not to block breathing.

In a further embodiment, the wrap can include a detachable pouch that releasably attaches to the body-supporting portion of the wrap at a position about centered on the wrap. The pouch wraps and fastens around the torso and arms of the infant but can leave the legs exposed.

In a further embodiment, elastic is sewn into the perimeter of the wrap at about the intersection of the head-supporting portion and the right and left wings so that the wrap gives at these positions for safety.

In a further embodiment, the infant swaddling wrap can include arm cuffs for maintaining the arms therein.

According to another embodiment of the invention, a preemie swaddling wrap is provided herein generally including a kite-shaped body defining a head-supporting portion, a bottom flap, and opposing right and left wings. A body-supporting portion and the head-supporting portion include padding for comfort. The head-supporting portion can define a recess generally centered therein for positioning the preemie's head therein. The recess preferably has a non-circular shape, and can, for example, have an arched top and flat bottom shape. The head-supporting portion preferably includes a lesser degree of padding to the sides of where the preemie's head is to be positioned to have a lower thickness profile to prevent any blocking of breathing. In a specific embodiment, the position to the sides of the head to be positioned can include one-ply padding and the positions above and below the head to be positioned can include two-ply padding. The preemie swaddling wrap can be constructed from any material or combination of materials including, but not limited to cotton, flannel, fleece and terry cloth.

According to another embodiment of the invention, an infant garment is provided herein including a body for covering an infant, and neck padding located within the body and extending from the base of the skull of an infant positioned on the body to the top of the shoulder blades (i.e., scapula) of the infant positioned on the body, and partway from shoulder-to-shoulder of the infant positioned on the body, wherein the neck padding includes a greater degree of padding than the body.

In a further embodiment, the body may be one of a sleeveless dress having a closed bottom, a kite-shaped body defining a body-supporting portion, a bottom flap and opposing right and left wings, wherein the bottom flap is configured to fold upward over the legs and torso of an infant, the right wing is configured to fold over the torso and the bottom flap, and the left wing is configured to fold over the torso and right wing, or a long-sleeved dress including right and left wings that fold over a top half of the dress to restrain sleeves of the dress in a folded configuration.

In a further embodiment, the neck padding may extend slightly above shoulder portions of the body and may have a convex polygon shape.

In a further embodiment, the body may include a primary restraint and a secondary restraint, wherein the primary restraint surrounds the infant and the secondary restraint surrounds the primary restraint.

In another embodiment, provided herein is an infant garment including a primary restraint for covering an infant's body, and neck padding located within the primary restraint and extending from the base of the skull to the top of the shoulder blades of an infant positioned on the primary restraint, and partway from shoulder-to-shoulder of the infant positioned on the primary restraint, wherein the neck padding includes a greater degree of padding than the surrounding primary restraint.

In a further embodiment, the primary restraint may be one of a sleeveless dress, a long-sleeved dress, and a kite-shaped wrap including a central portion, a bottom flap configured to fold in a direction of the central portion to form a form pocket, a right wing configured to fold over the central portion, and a left wing configured to fold over the central portion.

In a further embodiment, the neck padding may extend above shoulder portions of the primary restraint and may have a convex polygon shape.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which:

FIG. 7A is a top plan view showing the bottom flap folded upward over the legs and portion of the torso of the infant;

FIG. 7B shows the wrap wrapped in a manner such that the legs are left exposed;

DETAILED DESCRIPTION OF THE INVENTION

Figure 1:
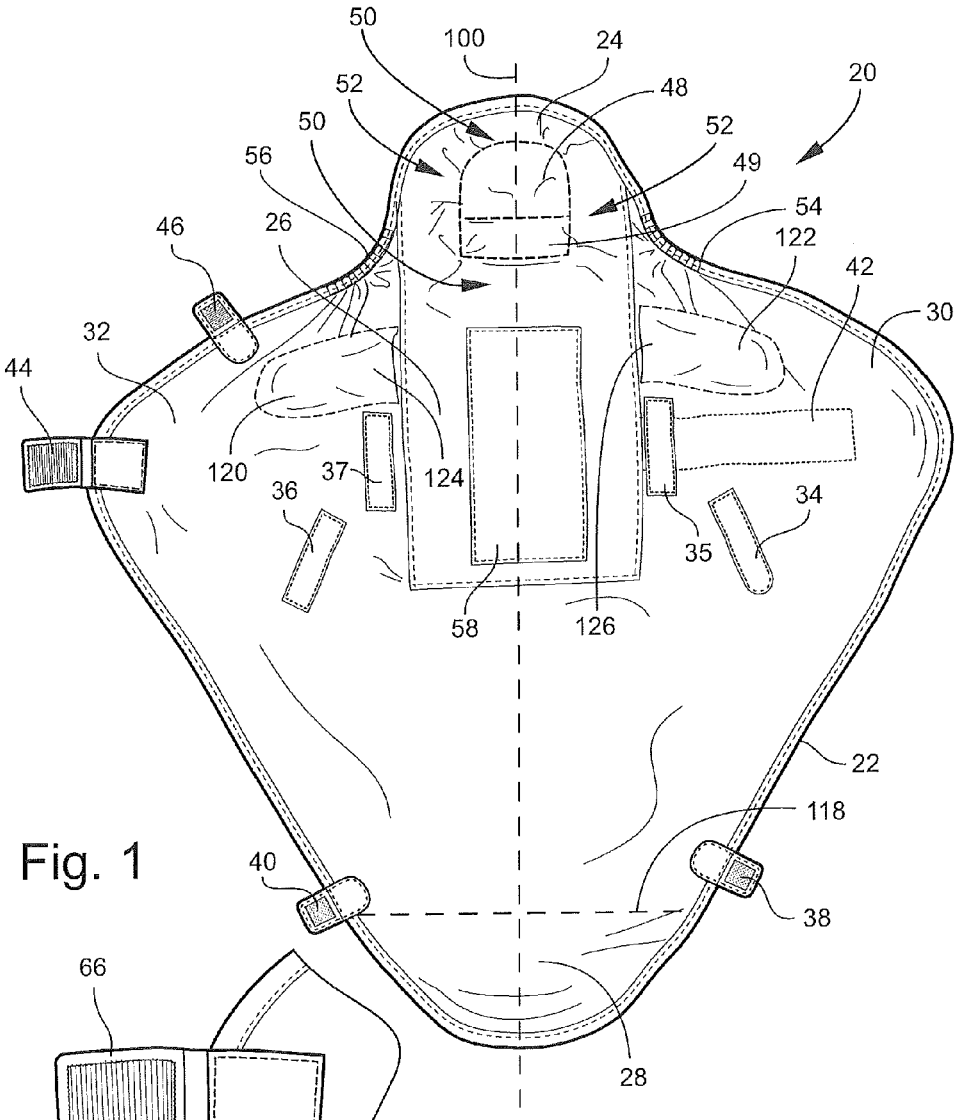
FIG. 1 is a top plan view of an infant swaddling wrap according to an embodiment of the invention and shown unfolded or fully "open"

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Referring to the drawings, infant and preemie swaddling wrap embodiments are provided for providing warmth and comfort to an infant or preemie to be swaddled. In use, the infant or preemie is positioned to be wrapped generally aligned along an imaginary centerline bisecting the wrap, with the head positioned on a dedicated head-supporting portion of the wrap and the body positioned on a dedicated body-supporting portion of the wrap. The wrap is then wrapped to form a pocket around the infant or preemie according to instructions described in detail below.

The wrap may be constructed from any material or combinations or materials chosen for comfort, moisture absorption, aesthetic reasons, etc. Suitable materials include cotton, flannel, fleece and terry cloth, among other. The wrap can include a border around its perimeter to finish the look of the wrap and prevent the material from fraying. Soft or padded materials are preferred for the entirety of the construction for comfort and safety reasons. The wrap may be any color and can include any indicia for customization.

Referring to FIGS. 1-10, an embodiment of an infant swaddling wrap is shown generally at reference numeral 20. The infant swaddling wrap 20 generally includes a kite-shaped body 22 defining a head-supporting portion 24, a body-supporting portion 26, a bottom flap 28, and opposing right and left wings 30, 32. The bottom flap 28 is configured to be folded upward over the legs and torso of an infant to be swaddled. The right wing 30 is configured to be folded over the torso and the folded bottom flap 28. The left wing 32 is configured to be folded over the torso and the folded right wing 30. All of the bottom flap 28, right wing 30 and left wing 32 fold to the same side of the wrap, i.e., the front.

The infant swaddling wrap 20 further includes a plurality of hook-and-loop fasteners attached to the body at a plurality of positions for releasably engaging with other plurality of positions on the kite-shaped body 22. As shown throughout FIGS. 1-10, the plurality of hook-and-loop fasteners attached to the kite-shaped body 22 can include first, second, third and fourth loop fasteners 34, 35, 36 and 37 attached to the right and left wings 30, 32, respectively, symmetrically about an imaginary centerline 100 bisecting the wrap, first and second hook fasteners 38, 40 attached along the perimeter of the bottom flap for releasably engaging with the first and second loop fasteners 34, 36, respectively, a fifth loop fastener 42 attached to the backside of the right wing 30, a third hook fastener 44 attached along the perimeter of the left wing 32 for releasably engaging with the fifth loop fastener 42 on the backside of the right wing 30, and a fourth hook fastener 46 attached along the perimeter of the left wing 32 at a position closer to the head-supporting portion 24 than the third hook fastener 44. Alternative numbers of fasteners and fastener positions are envisioned.

The head-supporting portion 24 and the body-supporting portion 26 preferably including a greater degree of padding than the bottom flap 28 and the right and left wings 30, 32, as these portions of the wrap are positioned between the infant and the underlying supporting surface, e.g., table or arms. The head-supporting portion 24 defines a non-circular recess 48 centered therein for positioning the head of the infant to be swaddled therein, the recess 48 being characterized by having a lesser degree of padding than the surrounding head-supporting portion. The recess can include an upper part 48 and a lower part 49 for seating the head and neck, respectively. In a specific embodiment, the head-supporting portion 24 includes a greater degree of padding above and below the recess, shown at reference numeral 50, and a lesser degree of padding to the sides of the recess, shown at reference number 52, in the plane of the wrap 20.

The recess 48 in the head-supporting portion 24 can be sewn into the body 22 and can serve as a visual guide for positioning the head of the infant on the head-supporting portion.

The infant swaddling wrap 20 further includes elastic sewn into the perimeter of the kite-shaped body 22 at an intersection of the head-supporting portion 24 and the right wing 30, shown at reference numeral 54, and an intersection of the head-supporting portion 24 and the left wing 32, shown at reference numeral 56. The length of the elastic can extend for several centimeters or longer, for example.

The body-supporting portion 26 is padded and includes one of a hook part or a loop part, shown at reference numeral 58, of a hook-and-loop fastener sewn therein.

Referring to FIGS. 3-8, the infant swaddling wrap 20 can further include a pouch 60 removably attached to the body-supporting portion 26, the removable pouch configured to wrap and fasten around the torso and arms of an infant to be wrapped. The pouch 60 includes on its backside the counterpart of the hook part or the loop part, shown at reference numeral 62 in FIG. 10, for releasably attaching the pouch to the body-supporting portion 26. FIGS. 7A-9 illustrate the wrapping steps.

Figure 2:
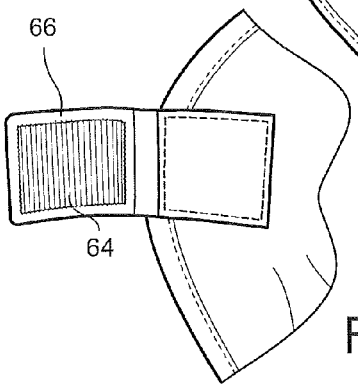
FIG. 2 is a detailed view of a hook-and-loop fastener framed with padding.
Figure 3:
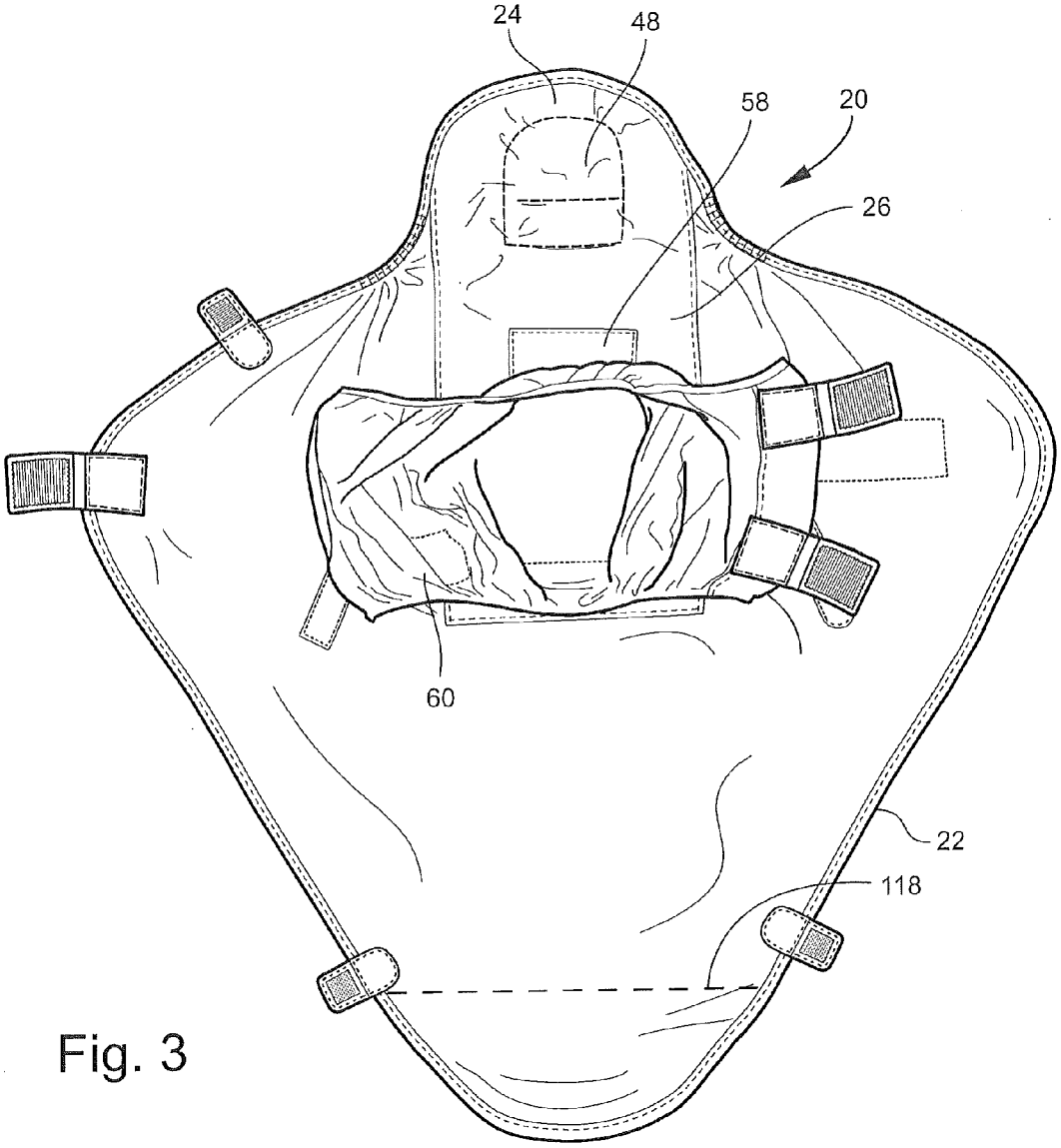
FIG. 3 is an unfolded view of the infant swaddling wrap shown with the removable pouch attached to the body-supporting portion of the wrap.
Figure 4:
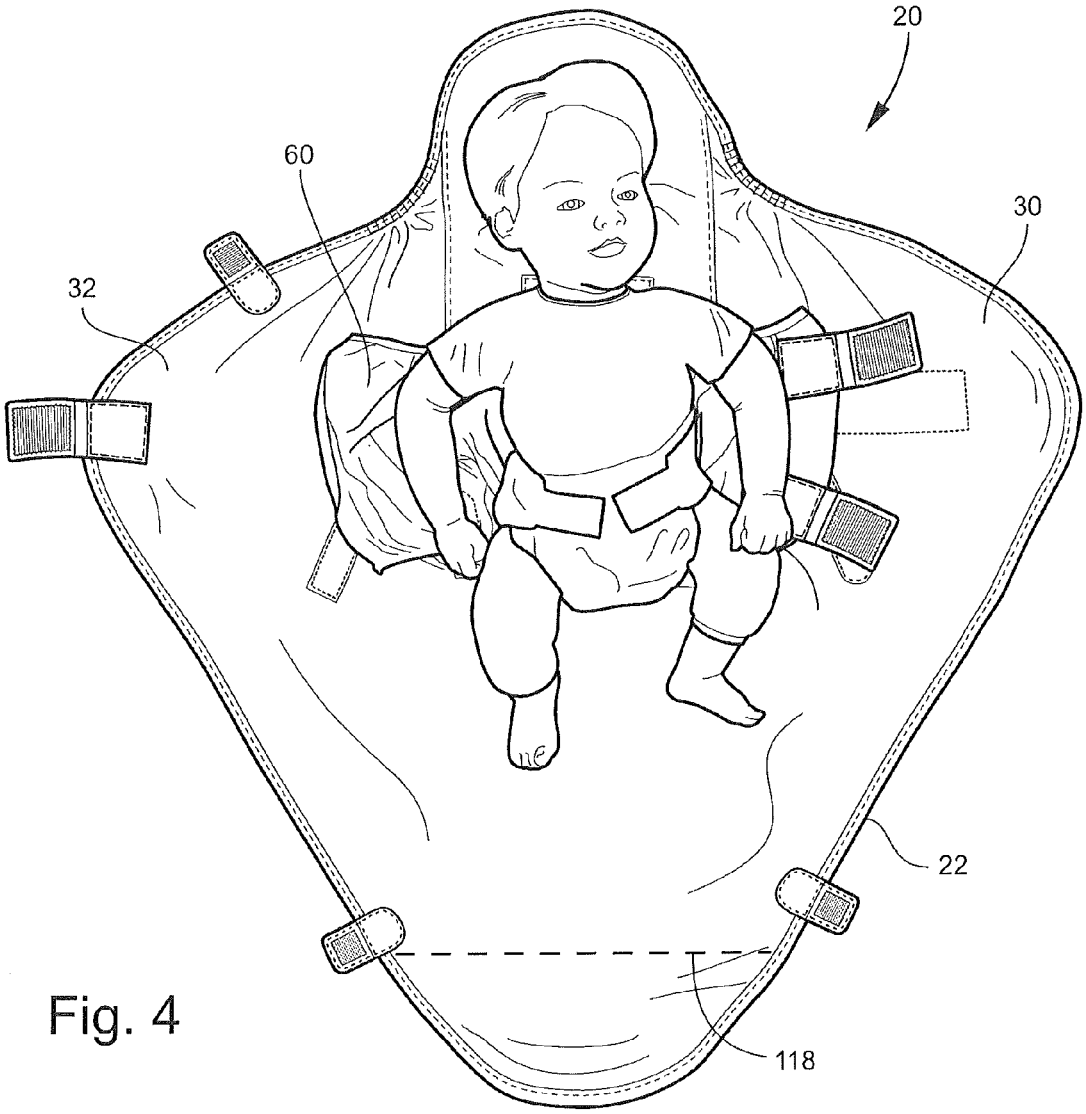
FIG. 4 is a top plan view of the infant swaddling wrap showing an infant in the proper position for being wrapped in the pouch and the wrap.
Figure 5:
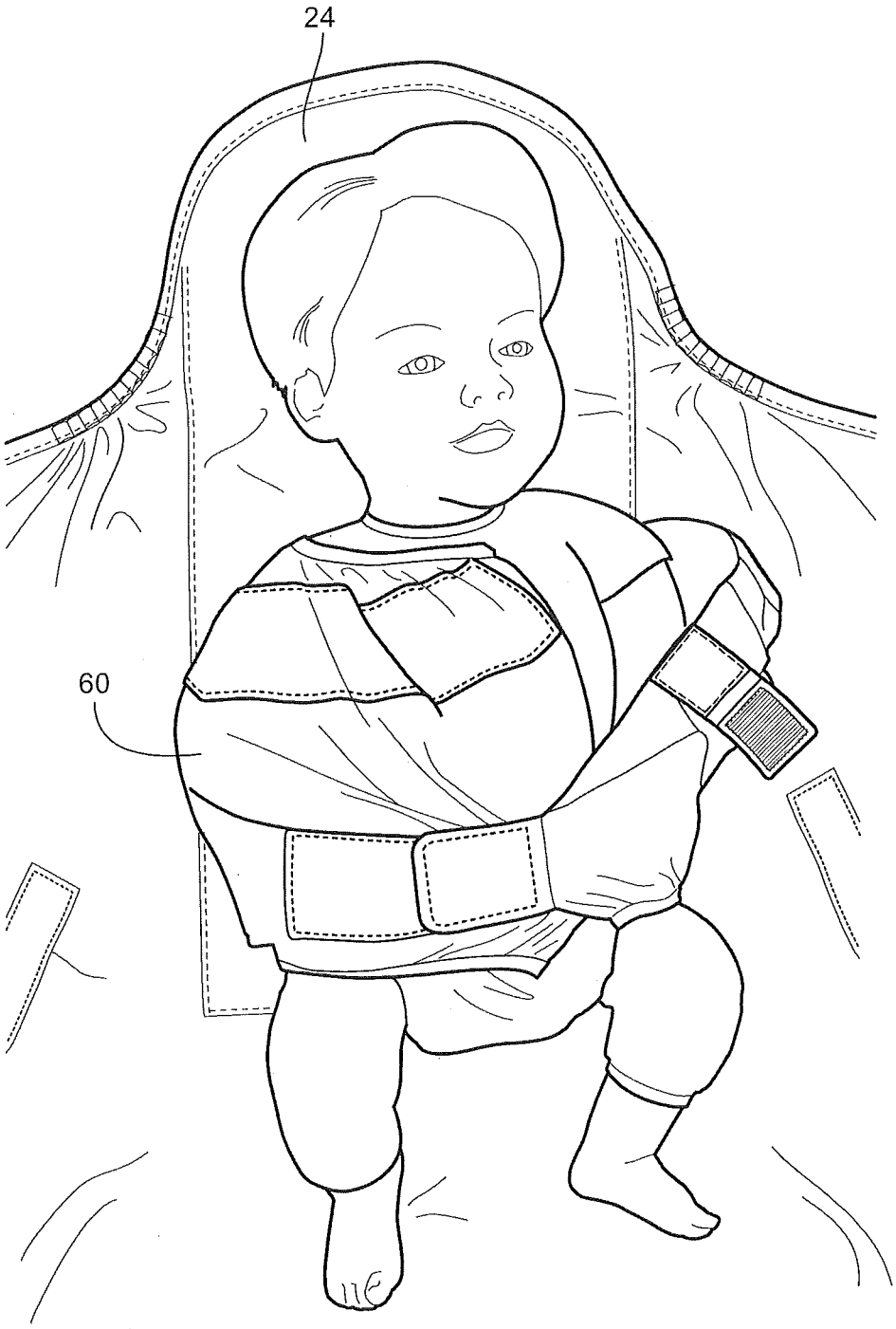
FIG. 5 is a detailed view showing the infant partially wrapped in the removable pouch.
Figure 6:
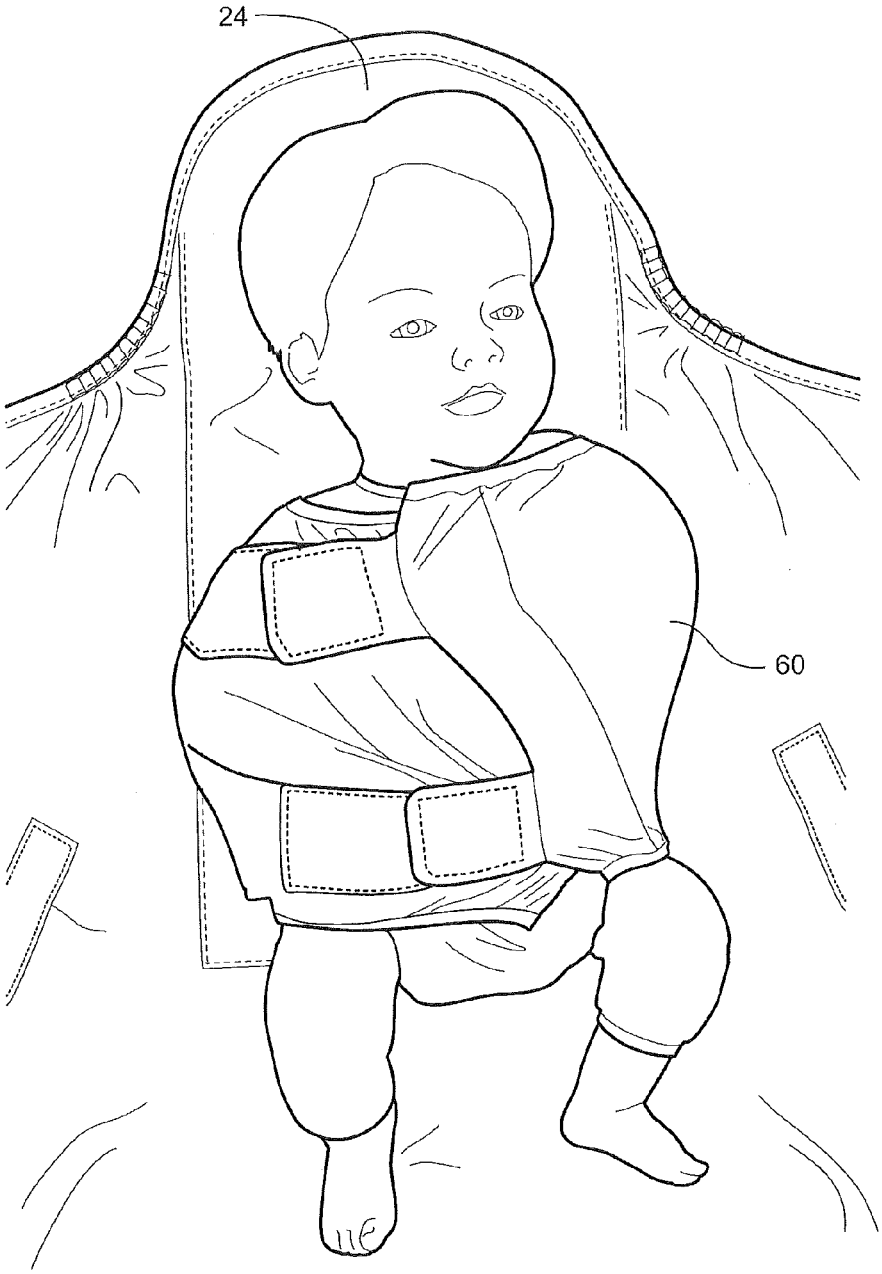
FIG. 6 is a detailed view showing the infant fully wrapped in the removable pouch.
Figure 8:
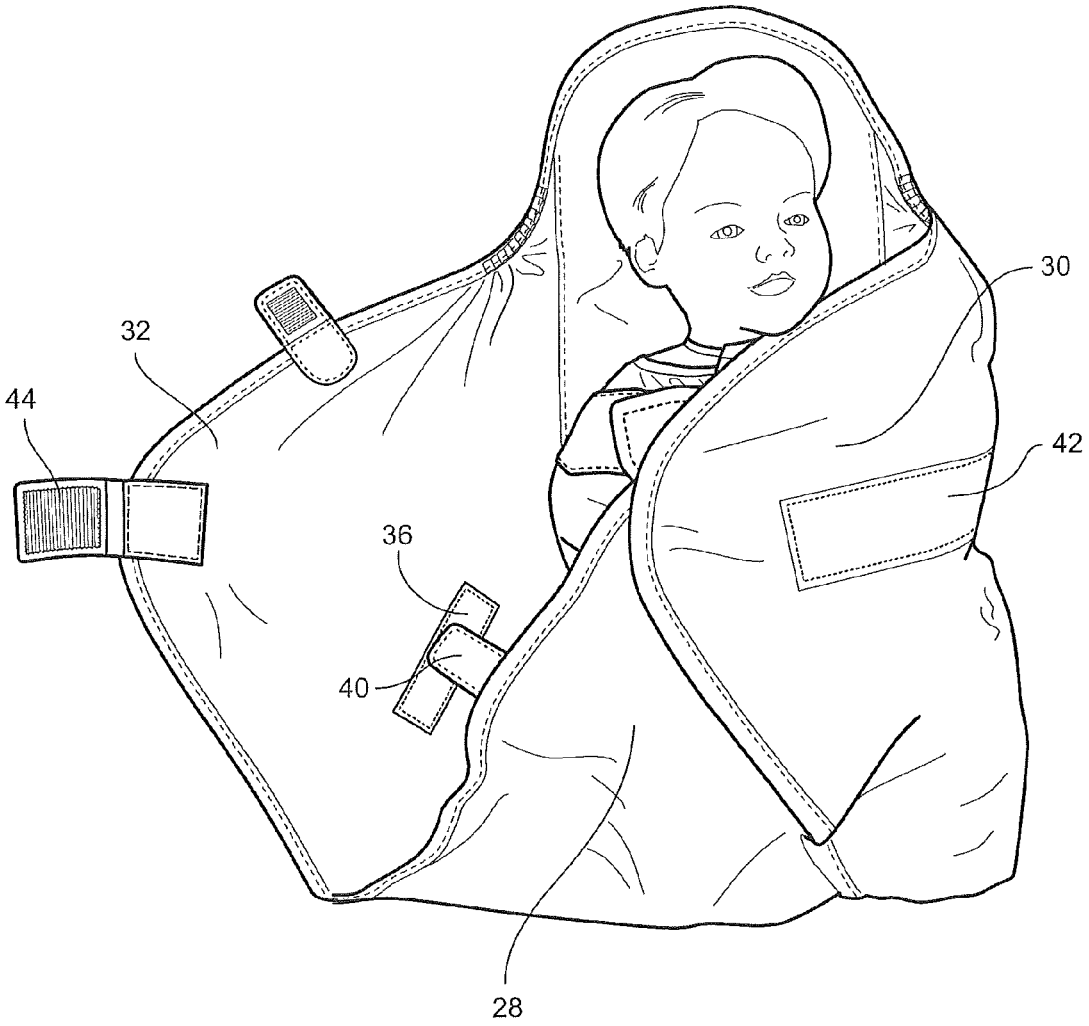
FIG. 8 is a top plan view showing the right wing folded over the bottom flap.
Figure 9:
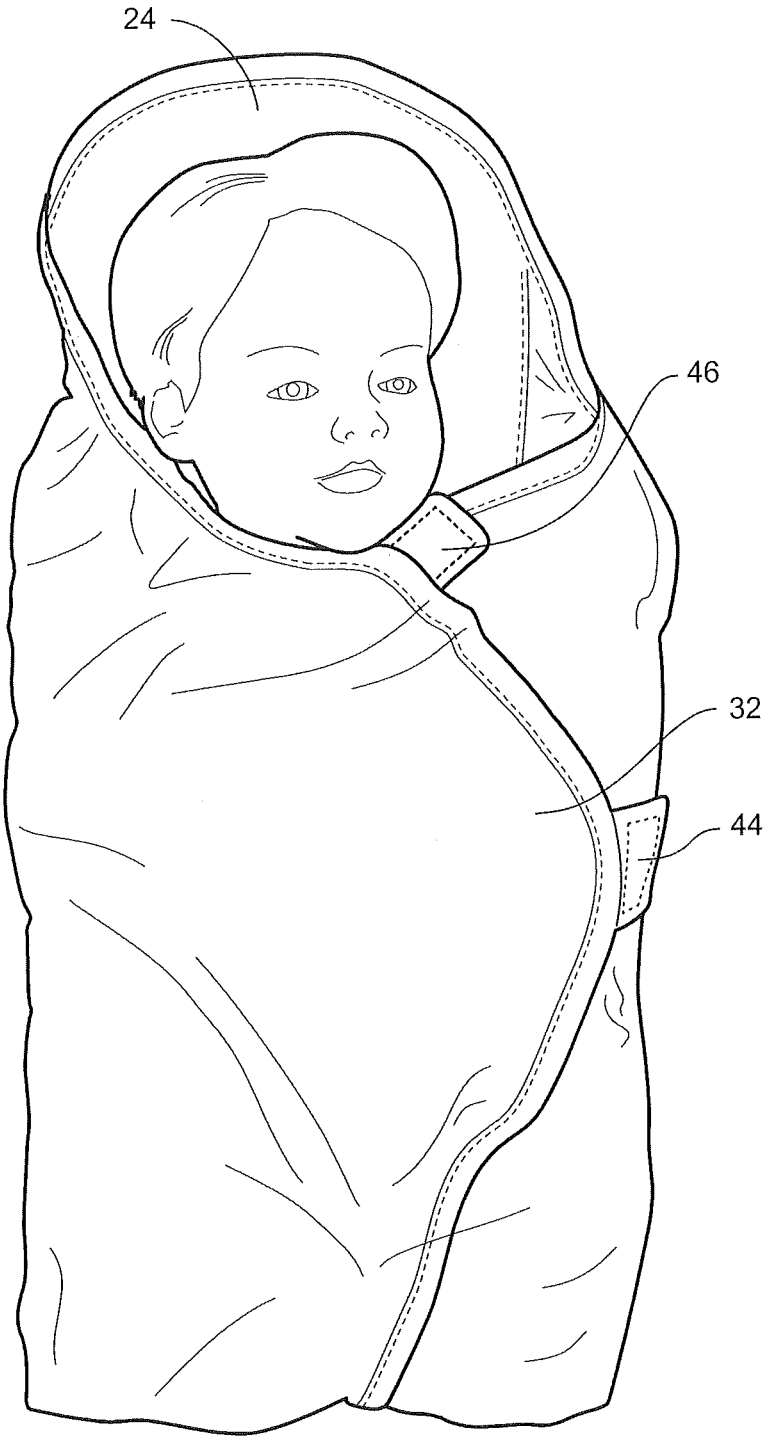
FIG. 9 is a top plan view showing the left wing folded over the right wing and releasably fastened thereto.
Figure 10:
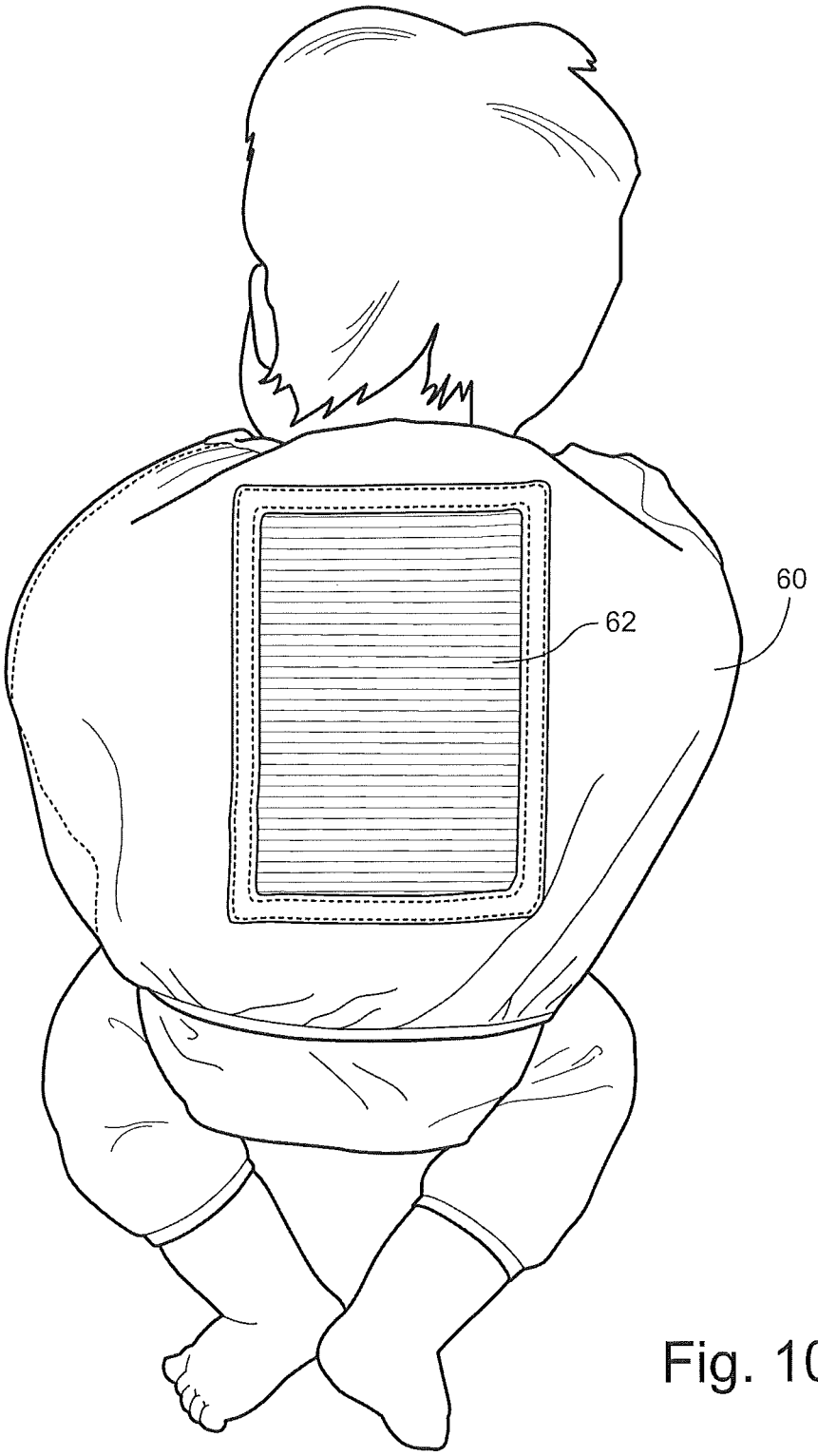
FIG. 10 is a back view of the removable pouch showing a portion of the hook-and-loop fastener for engaging the counterpart portion of the hook-and-loop fastener on the inside of the wrap.
Figure 11:
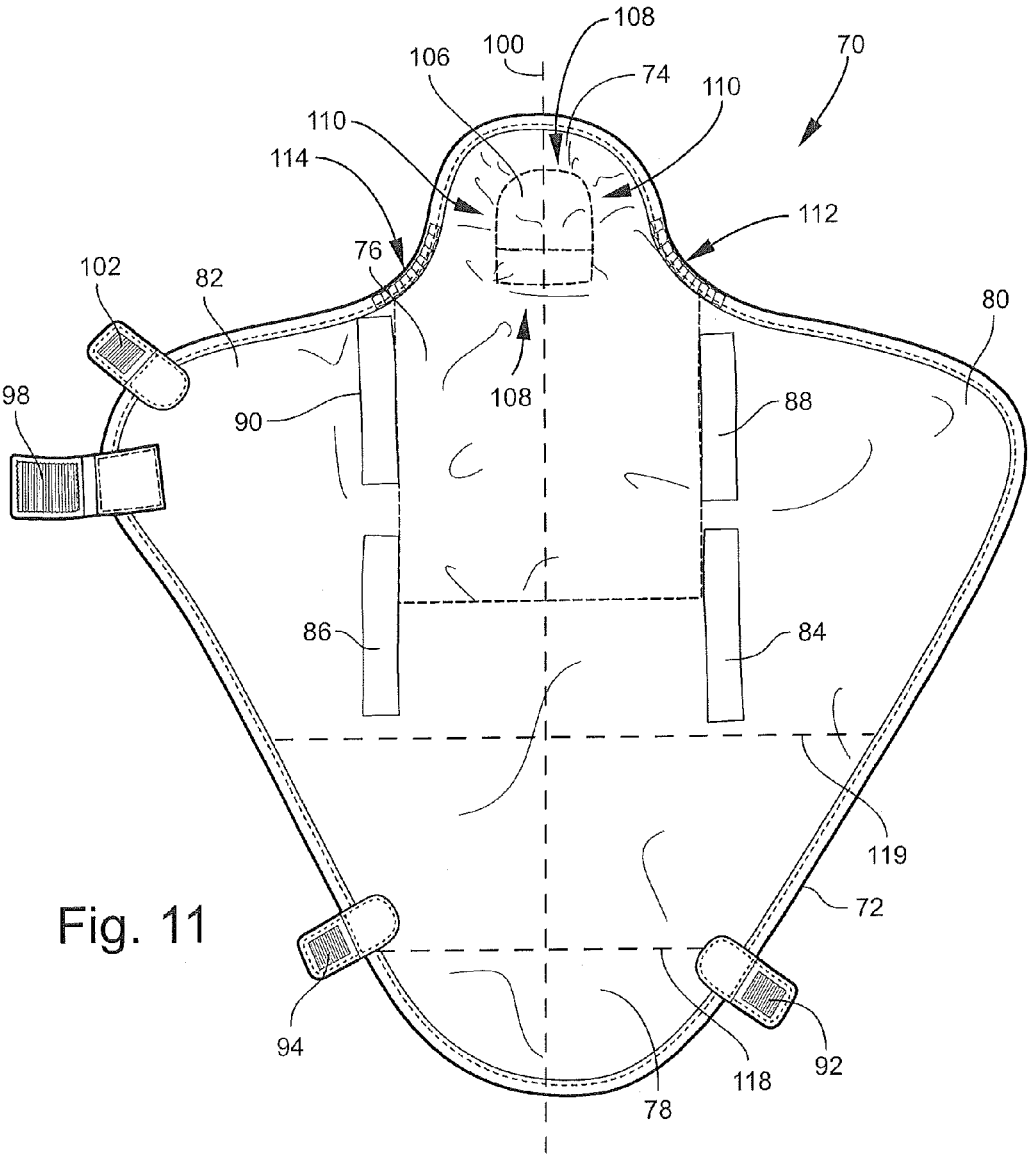
FIG. 11 is a top plan view of a preemie swaddling wrap according to an embodiment of the invention and shown unfolded or "open"
Figure 12:
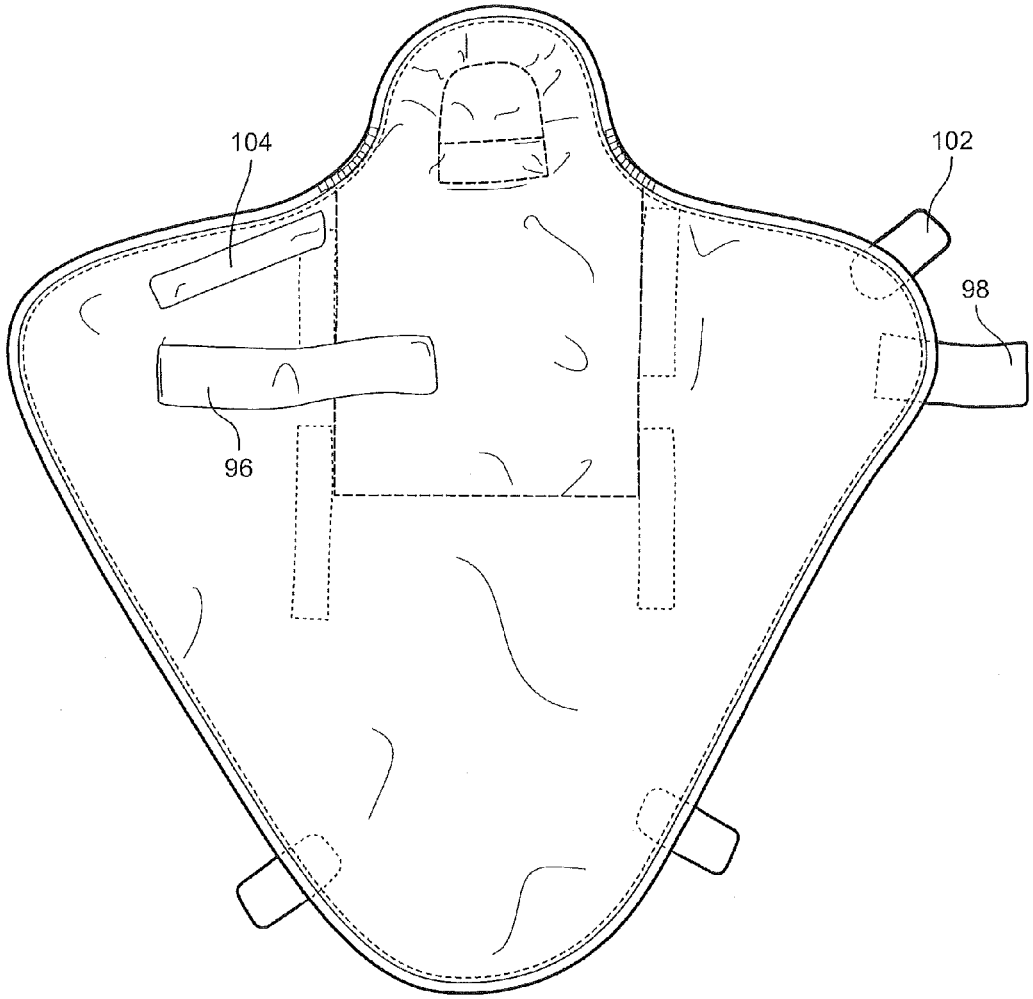
FIG. 12 is a bottom plan view of the preemie swaddling wrap.

Referring to detail FIG. 2, the plurality of hook-and-loop fasteners attached along the perimeter of the kite-shaped body can include hook fasteners 64 framed with padding 66 for safety. Framing the edges and corners of the hook fasteners in padding allows the use of high-strength or highly-pull resistant fasteners to maintain the wrap in its folded configuration. High strength fasteners are typically defined by a rigid backing or substrate including a greater number of hooks than a standard hook-and-loop fastener. This rigid backing exposes the infant to sharper corners that could harm the infant on contact therewith, and thus requires padding in the form of framing to conceal the edges and corners.

Referring to FIG. 7B, in another embodiment, the swaddling wrap 20 can be folded around the infant such that the legs are left exposed.

The bottom flap 28 is folded upward to cover the infant's torso and optionally the legs, and can be folded along any line transverse to the imaginary centerline 100 depending on the length of the infant. The wrap 20 can further include a fold line 118 transverse to the imaginary centerline 100 to indicate where the bottom flap 28 should be folded back downward so as not to cover the head to prevent any blocking of breathing.

Referring again to FIG. 1, the infant swaddling wrap 20 can include right and left arm cuffs 120, 122 for receiving the right and left arms therein, respectively, to prevent the arms from being freed to disturb the wrapped configuration. By maintaining the arms in the arm cuffs 120, 122, the wrap can safely function as a sleeping wrap and the infant can be left unattended. The arm cuffs 120, 122 can be formed by attaching the cuffs to the face of the inner layer of the wrap, or by sewing inner and outer layers of the wrap together to define the cuffs while leaving openings 124, 126 for receiving the arms therein. Thus, the wrap 20 can be a single layer design or a multi-layer design depending on the inclusion of the arm cuffs 120, 122, or for other reasons such as warmth, padding, etc. The right and left arm cuffs 120, 122 can be constructed from two-way stretch material, among other materials.

Referring to FIGS. 11-15, an embodiment of a preemie swaddling wrap is shown generally at reference numeral 70. Like the infant swaddling wrap 20, the preemie swaddling wrap generally includes a kite-shaped body 72 defining a head-supporting portion 74, a body-supporting portion 76, a bottom flap 78, and opposing right and left wings 80, 82. With the preemie properly positioned in alignment with the head-supporting portion 74 and the body-supporting portion 76, the bottom flap 78 is folded upward over the legs and torso of the preemie to be swaddled, followed by folding the right wing 80 over the torso and the bottom flap 28, followed by folding the left wing 82 over the torso and right wing 80.

The preemie swaddling wrap 70 further includes a plurality of hook-and-loop fasteners attached to the body 72 at a plurality of positions for releasably engaging with other plurality of positions on the kite-shaped body. The plurality of hook-and-loop fasteners attached to the kite-shaped body 72 can include first, second, third and fourth loop fasteners 84, 86, 88 and 90 positioned about the vertical sides of the body-supporting portion 76. As shown, fasteners 84 and 88 may be positioned in vertical alignment along the right side of the body supporting portion 76, and fasteners 86 and 90 may be positioned in vertical alignment along the left side of the body-supporting portion 76. The first, second, third and fourth fasteners 84, 86, 88 and 90 can be symmetrically arranged about an imaginary centerline 100 bisecting the wrap. The plurality of fasteners further include first and second hook fasteners 92, 94 attached along the perimeter of the bottom flap 78 for releasably engaging with the first and third 84, 88, and second and fourth 86, 90 fasteners, respectively. The plurality of fasteners further include a fifth loop fastener 96 attached to the backside of the right wing 80, a third hook fastener 98 attached along the perimeter of the left wing 82 for releasably engaging with the fifth loop fastener 96 on the backside of the right wing 80, and a fourth hook fastener 102 attached along the perimeter of the left wing 82 at a position closer to the head-supporting portion 74 than the third hook fastener 98. The fourth hook fastener 102 can releasably engage with a sixth loop fastener on the backside of the right wing 80. Alternative numbers of fasteners and fastener positions are envisioned. For example, the first loop fastener 84 and the third loop fastener 88 can be one single elongate loop fastener, and the second loop fastener 86 and the fourth loop fastener 90 can be one single elongate loop fastener.

The head-supporting portion 74 and the body-supporting portion 76 preferably including a greater degree of padding than the bottom flap 78 and the right and left wings 80, 82, as these portions of the wrap are positioned between the infant and the underlying supporting surface, e.g., table or arms. The head-supporting portion 74 defines a non-circular recess 106 centered therein for positioning the head of the infant to be swaddled therein, the recess 106 being characterized by having a lesser degree of padding than the surrounding head-supporting portion. In a specific embodiment, the head-supporting portion 74 includes a greater degree of padding above and below the recess, shown at reference numeral 108, and a lesser degree of padding to the sides of the recess, shown at reference number 110, in the plane of the wrap 70.

The recess 106 in the head-supporting portion 74 can be sewn into the body 72 and can serve as a visual guide for positioning the head of the infant on the head-supporting portion. As shown, the recess is shaped with an arched top and a flat bottom.

The preemie swaddling wrap 70 further includes elastic sewn into the perimeter of the kite-shaped body 72 at an intersection of the head-supporting portion 74 and the right wing 80, shown at reference numeral 112, and an intersection of the head-supporting portion 74 and the left wing 82, shown at reference numeral 114. The length of the elastic can extend for several centimeters or longer, for example. The body-supporting portion 76 is preferably padded.

Figure 13:
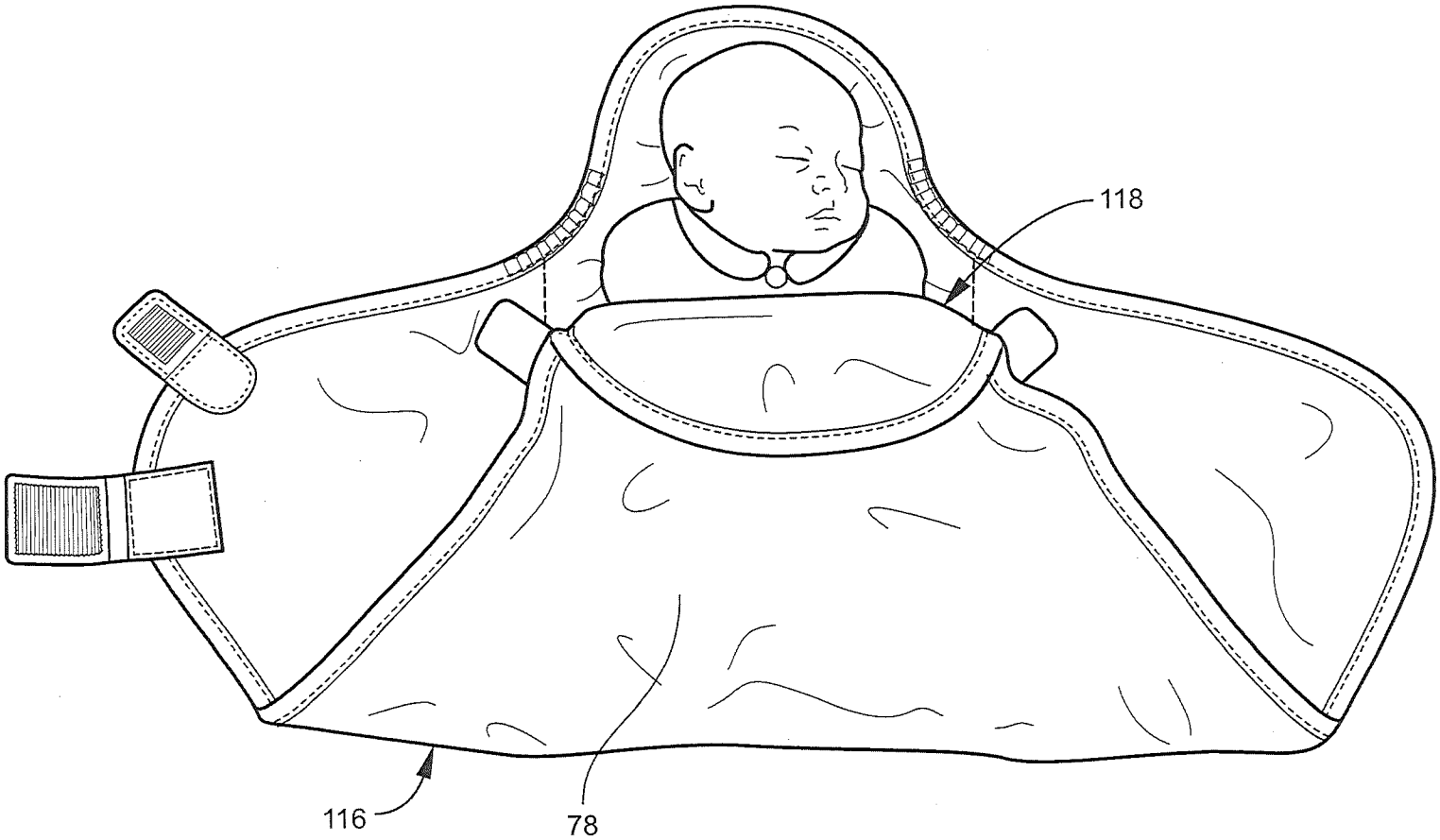
FIG. 13 is a top plan view showing the bottom flap folded upward to cover the preemie's legs and torso, and with a portion of the bottom flap folded downward so as not to cover the preemie's head and neck.
Figure 14:
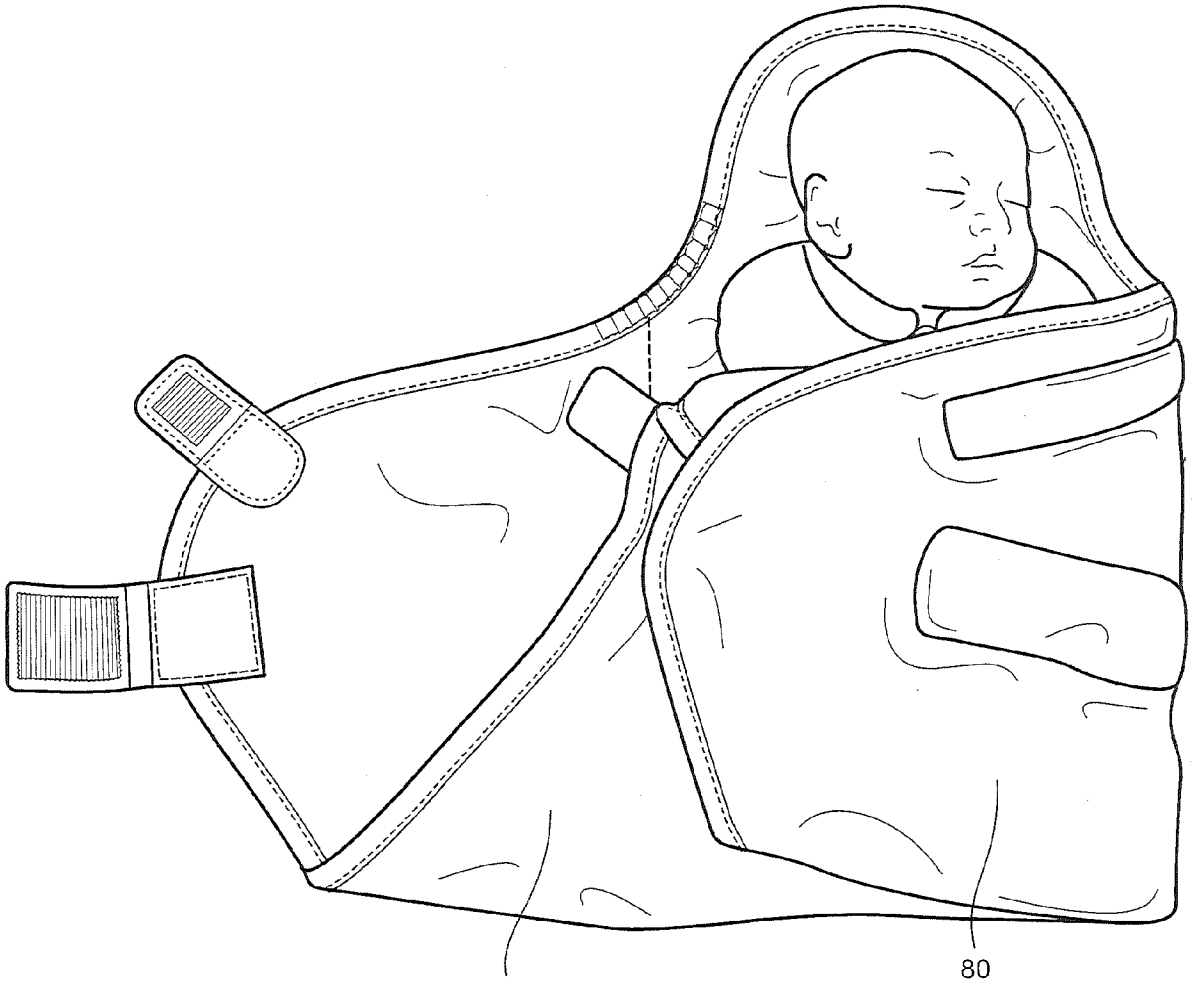
FIG. 14 is a top plan view showing the right wing folded across the torso and over the bottom flap.
Figure 15:
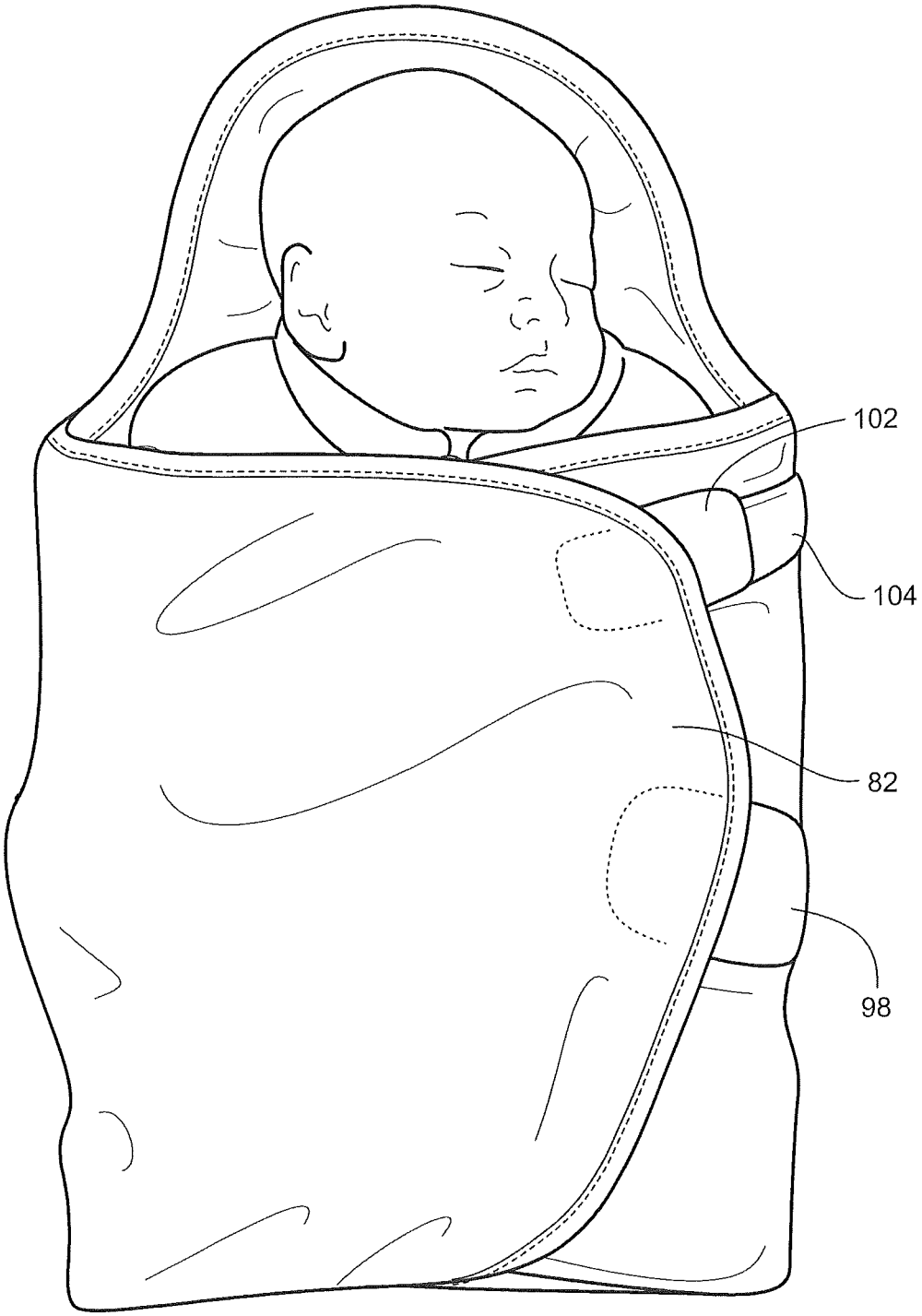
FIG. 15 is a top plan view showing the left wing folded over the right wing and releasably fastened thereto.

Referring to FIG. 13, the bottom flap 78 is folded upward about a first fold 116 transverse to the imaginary centerline 100 bisecting the wrap 70 to cover the legs and torso of the preemie, and about a second fold 118 transverse to the imaginary centerline 100 to uncover the preemies head and prevent any blocking of breathing. FIG. 14 illustrates the folding of the right wing 80 over the torso and folded bottom flap 78, and FIG. 15 illustrates the folding of the left wing 82 over the torso and right wing 80 and the fastener attachments.

Like the infant swaddling wrap 20, the preemie swaddling wrap 70 preferably includes hook-and-loop fasteners framed with padding for safety. Framing the edges and corners of the hook fasteners in padding allows the use of high-strength or highly-pull resistant fasteners to maintain the wrap in its folded configuration. High strength fasteners are typically defined by a rigid backing or substrate including a greater number of hooks than a standard hook-and-loop fastener. This rigid backing exposes the infant to sharper corners that could harm the infant on contact therewith, and thus requires padding in the form of framing to conceal the edges and corners.

Figure 16:
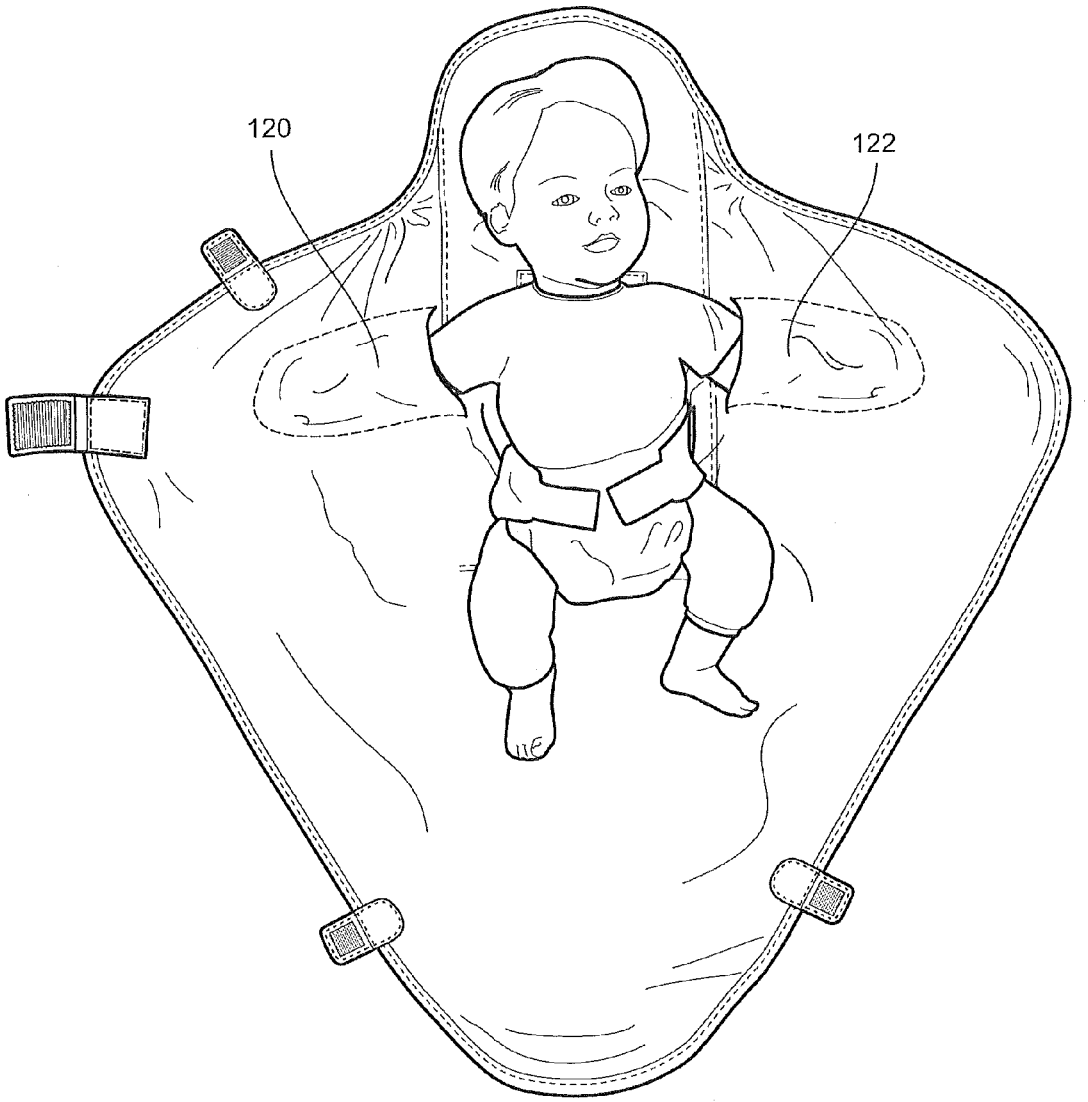
FIG. 16 shows optional arm cuffs for use with one or more of the infant and preemie swaddling wraps.
Figure 17:
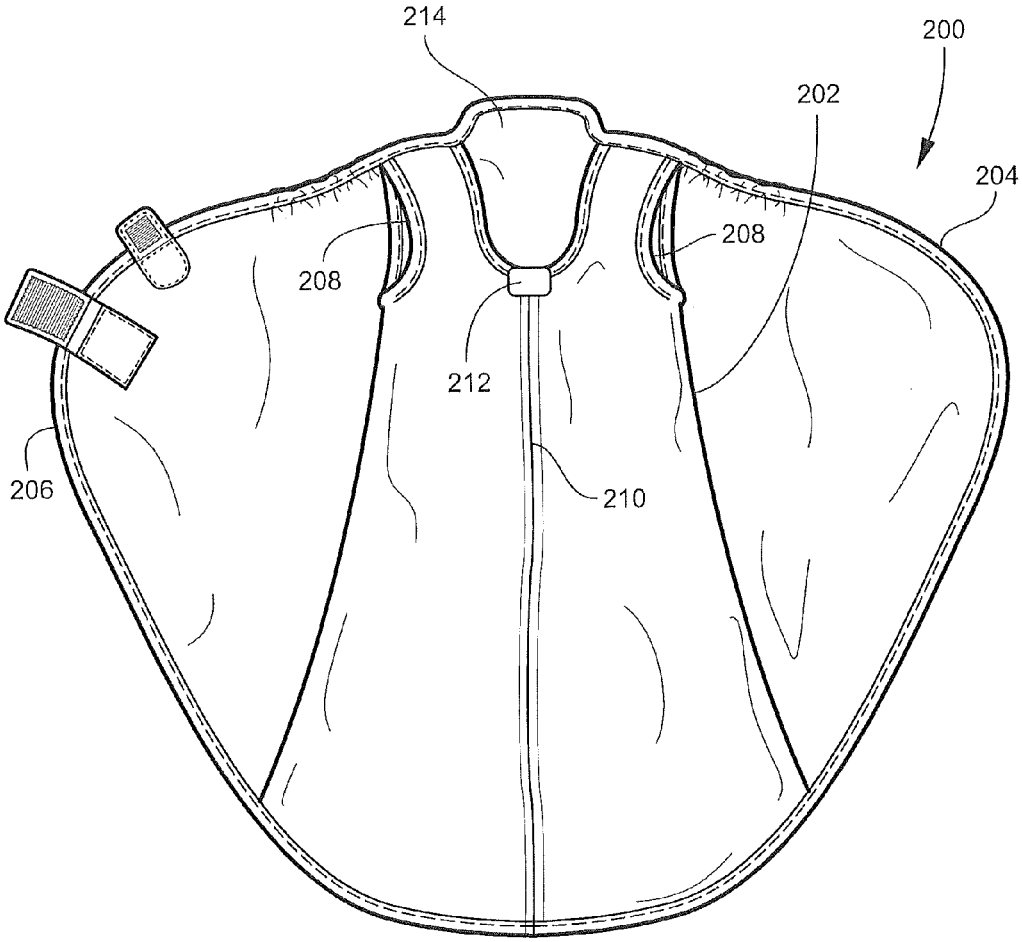
FIG. 17 is a front view of another embodiment of a swaddle including neck padding.

Referring to FIG. 16, arms cuffs for use with one or more of the infant swaddling wrap 20 and preemie swaddling wrap 70 are shown. Right arm cuff 120 and left arm cuff 122 receive the right and left arms, respectively, therein to secure the arms. The arm cuffs permit safe unattended sleeping in the wraps because the infant or preemie is unable to move their arms disturb the folded configuration of the wrap. The arm cuffs can be sewn to body along their perimeter leaving one end open for receiving the arms therein, or can be created between layers of the wrap as described in detail above.

Referring to FIGS. 17-20, another embodiment of an infant and preemie swaddling wrap is shown generally at reference numeral 200. The wrap 200 generally includes a dress 202 (i.e., primary restraint) flanked by right and left wings 204, 206 (i.e., secondary restraint) foldable one over the other over the dress 202. The dress 202 is sleeveless and is sewn closed along the bottom and sides. The infant's arms extend through the arm openings 208 and can be folded over the body and held in place when the wings 204, 206 are folded over the dress and fastened using the hook-and-loop fasteners similar to those described above.

A zipper 210 longitudinally bisects the dress and unzips to open the dress to insert/remove the infant. A flap 212 folds over the zipper and fastens, for example by way of hook-and-loop, fastener, to prevent the infant from pulling on the zipper and to protect the infant from the zipper slider. The neck portion of the dress is wide enough and has a neckline that plunges sufficiently so as not to constrict the infant's neck or block breathing.

Figure 18:
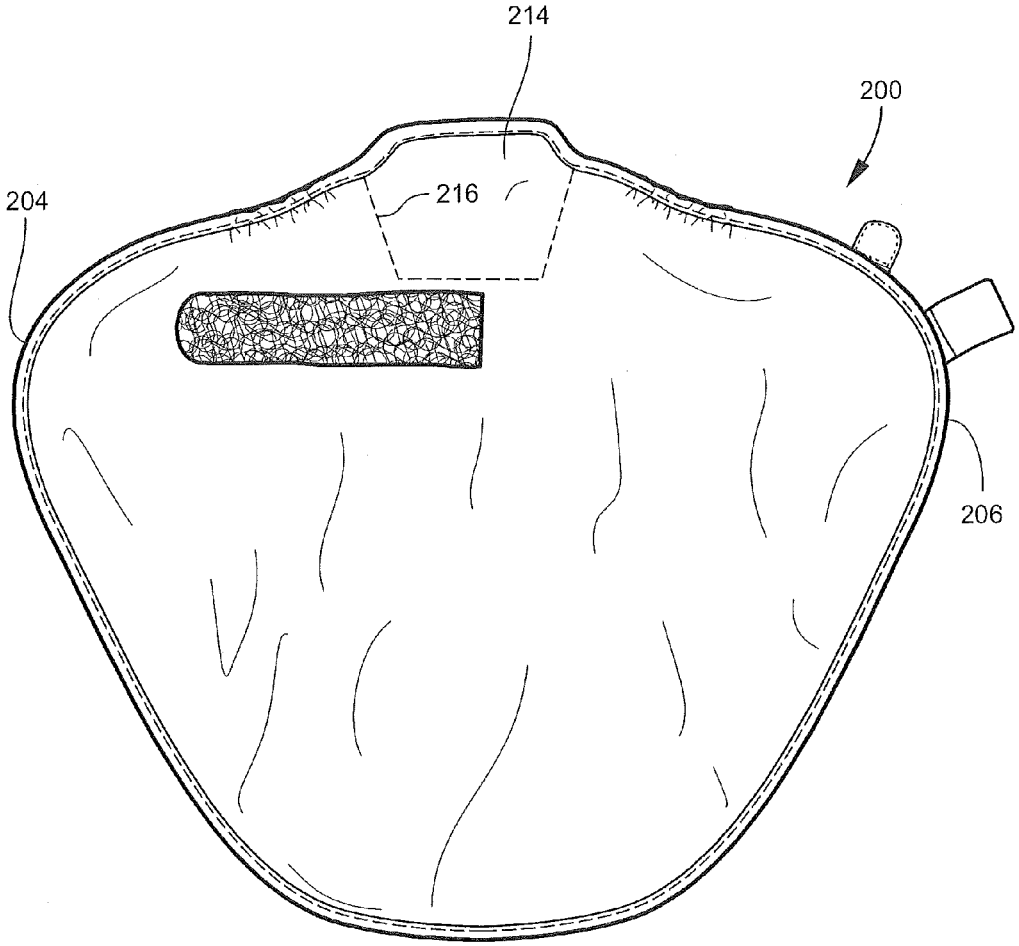
FIG. 18 is a back view of the swaddle of FIG. 17 illustrating the location of the neck padding.

The wrap 200 includes neck padding 214 that supports the infant's neck from behind. As best illustrated in FIG. 18 at imaginary or stitch line 216, the neck padding extends from about the base of the skull to about the top of the shoulder blades, and extends left-to-right partway from shoulder-to-shoulder. In a particular embodiment, about one-half of the shoulders are supported by the neck padding 214. The neck padding includes a greater degree of padding than the surrounding wrap and dress so as to support the neck from behind and keep the head titled slightly back when the infant is laying on its back to promote better breathing. The neck padding extends only to the base of the skull and does not extend to behind the head when the infant is properly positioned in the wrap.

Figure 19:
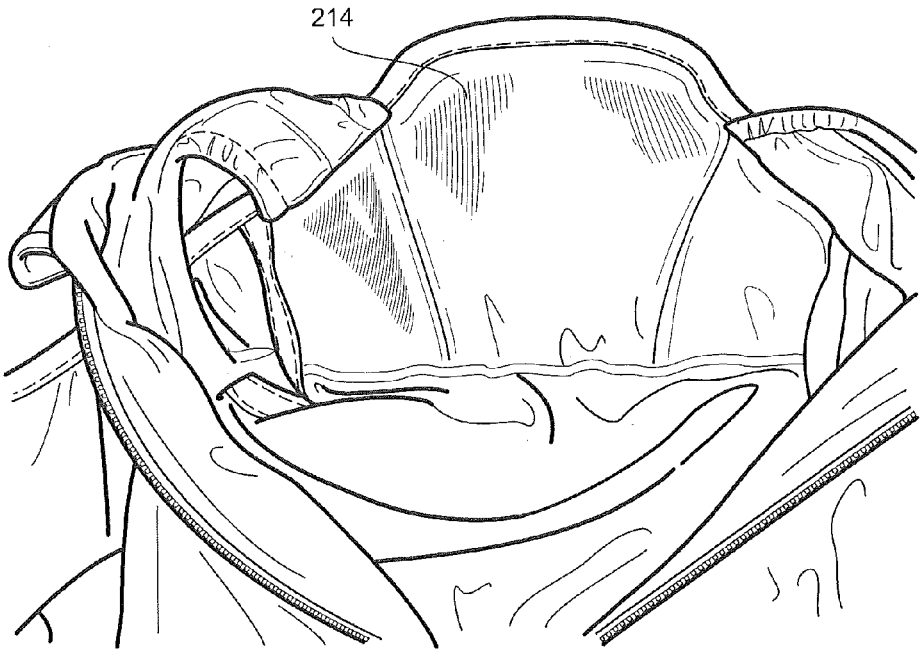
FIG. 19 is a detailed view of the neck padding of the swaddle of FIG. 17.
Figure 20:
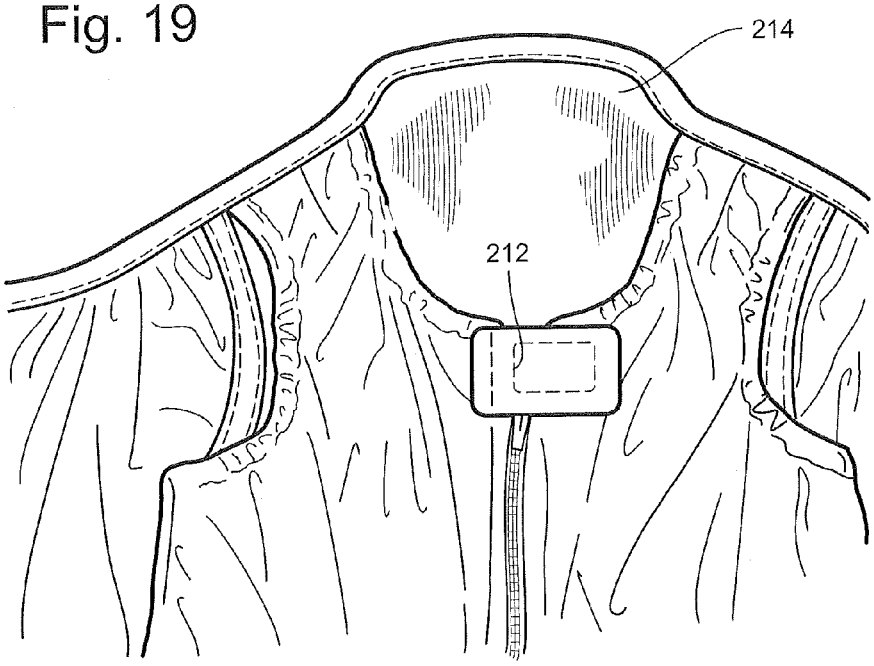
FIG. 20 is a detailed view of the neck portion of the swaddle of FIG. 17.

As best shown in FIG. 19, the neck padding 214 is sewn into one or more layers of the wrap 200 and has a convex polygon shape. The neck padding 214 extends slightly higher between the shoulders to support the neck from behind, and extends into the wrap to about where the top of the shoulder blades are positioned. The neck padding 214 can include one or more layers of padding and can be sewn in at multiple places to prevent the padding from moving and bunching.

Figure 21:
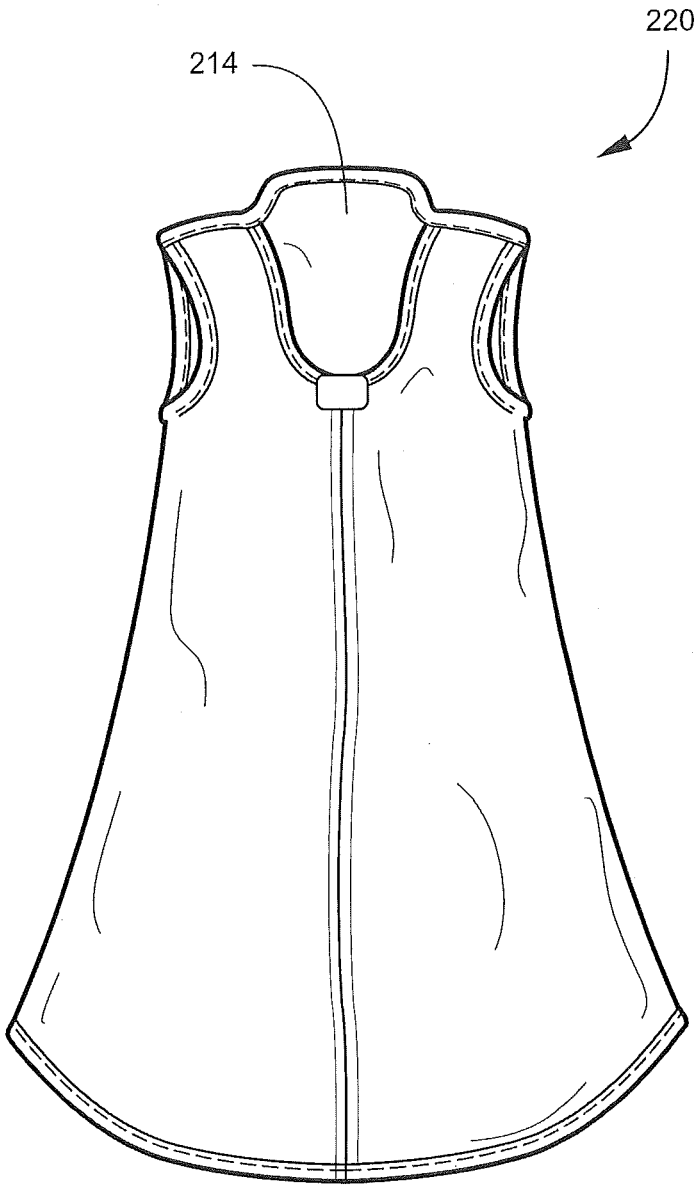
FIG. 21 is a front view of another embodiment of an infant garment including neck padding.
Figure 22:
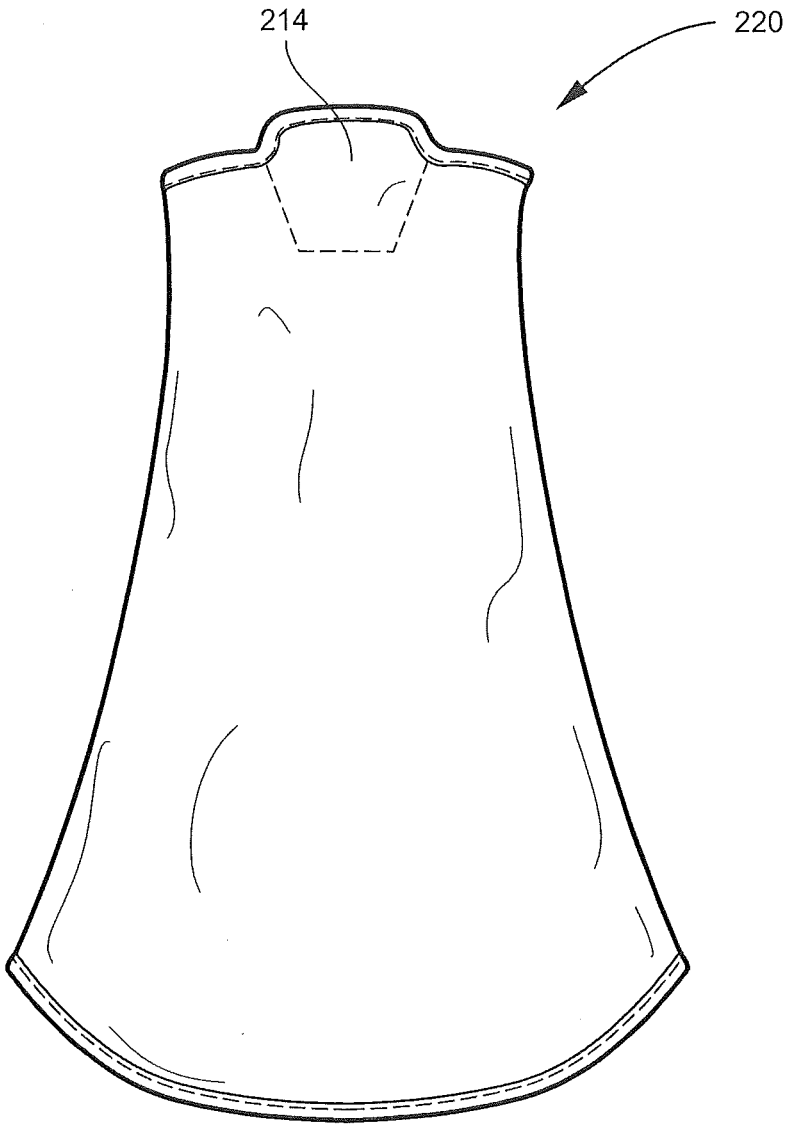
FIG. 22 is a back view of the garment of FIG. 21 illustrating the location of the neck padding.
Figure 23:
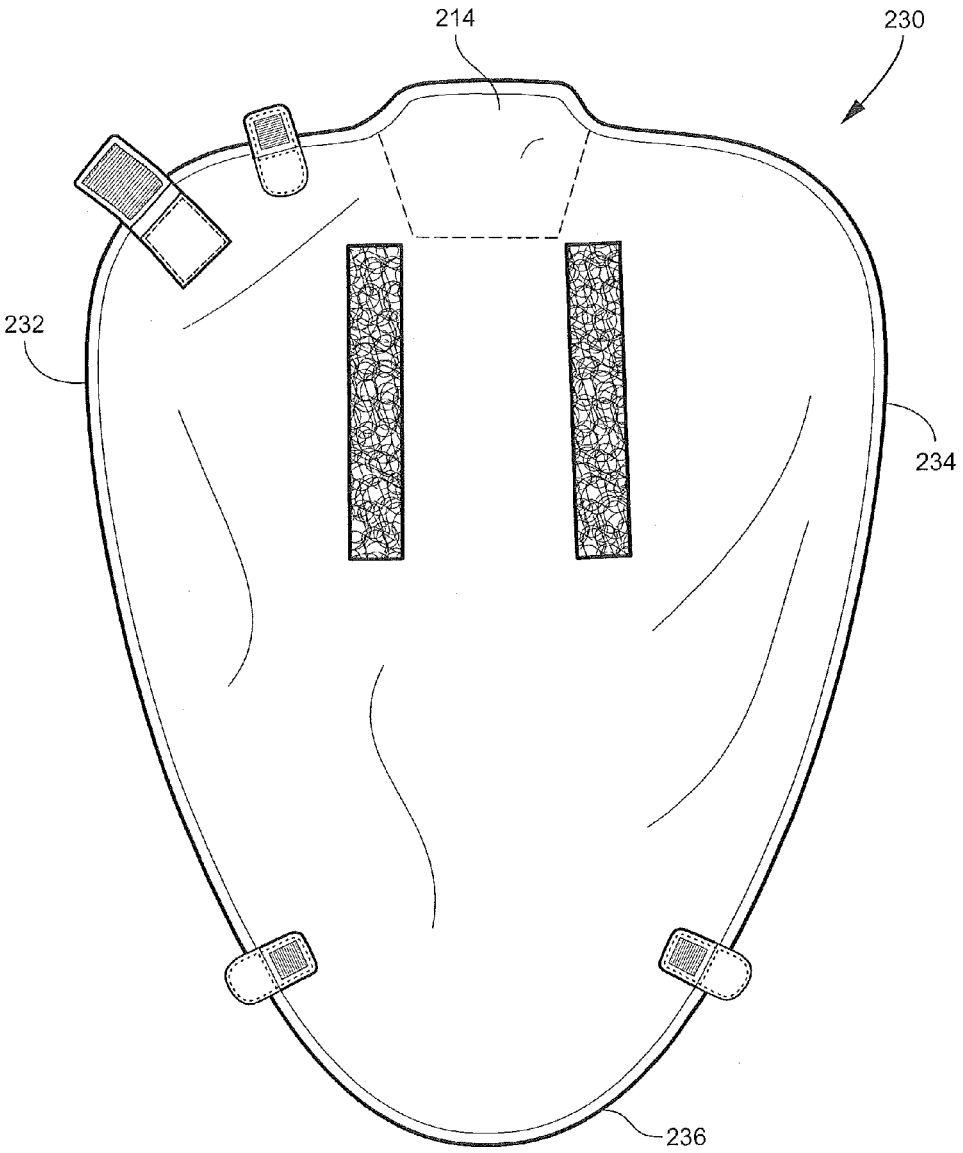
FIG. 23 is a front view of another embodiment of a swaddle including neck padding.
Figure 24:
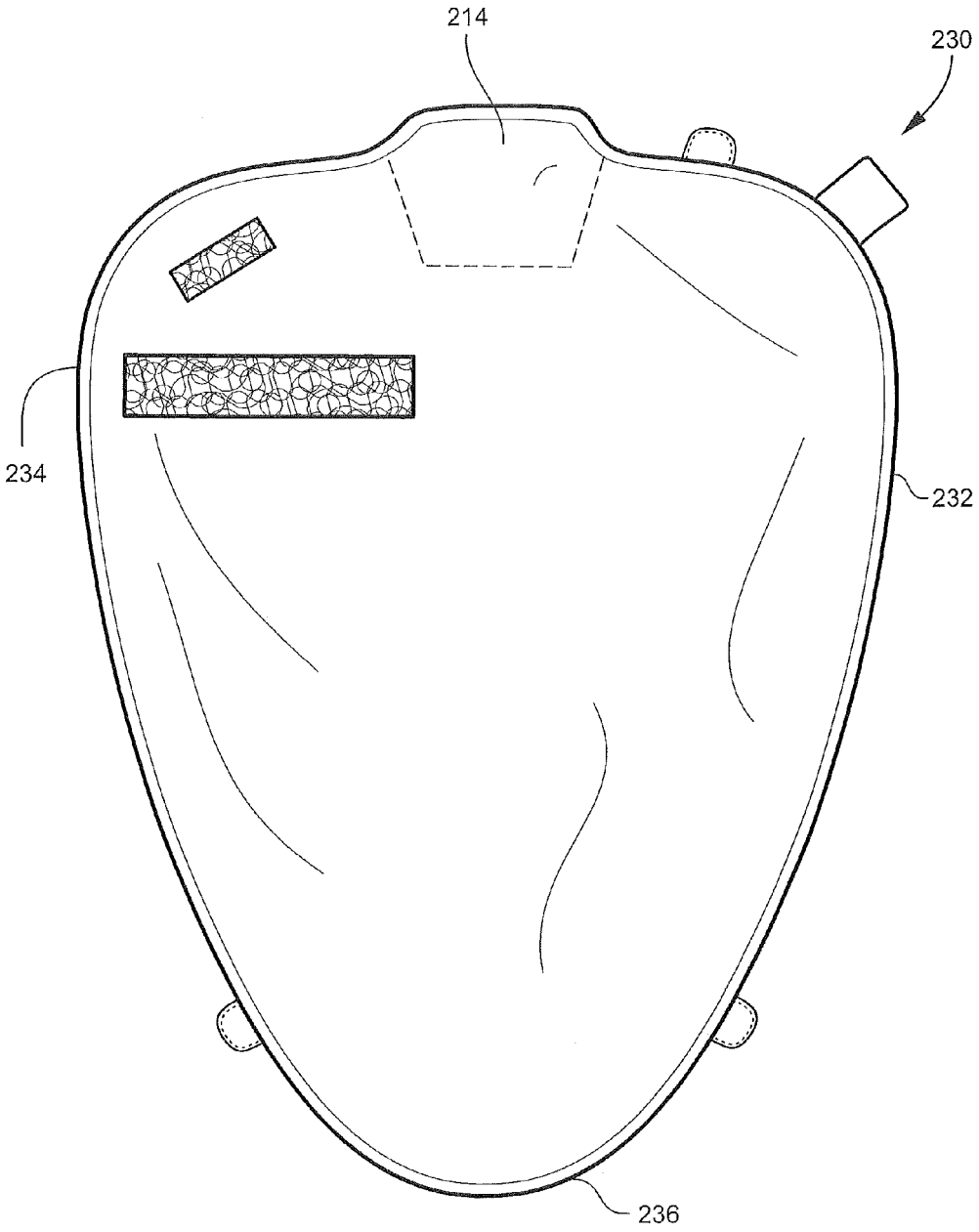
FIG. 24 is a back view of the swaddle of FIG. 23 illustrating the location of the neck padding.

Referring to FIGS. 21 and 22, another embodiment of a garment including neck padding is shown generally at reference numeral 220. Garment 220 is essentially the dress 202 of wrap 200 without the folding wings, and thus includes only one restraint. The garment 220 includes the same neck padding 214 for supporting the neck from behind Referring to FIGS. 23 and 24, another embodiment of a wrap including neck padding is shown generally at reference numeral 230. Wrap 230 is similar to the kite-shaped wrap discussed above, but with the neck padding 214 as opposed to head padding. The wrap 230 includes left and right wings 232, 234 that fold over the body and a bottom portion 236 that folds up to form a foot pocket. The wrap 230 may include one part of hook-and-loop fasteners on the central body portion for receiving the complementary part of the fasteners for attaching an inner restraint to the wrap, such as the restraint shown in FIG. 3. As shown, the wrap 230 includes two parallel strips of loop fasteners arranged vertically for attaching a primary restraint. The wings 232, 234 function as the secondary restraint when folded over and secured. As in the two previous embodiments, the neck padding 214 extends from the base of the skull to the top of the shoulders blades and from shoulder-to-shoulder. The neck padding 214 includes a greater degree of padding than the rest of the wrap 230.

Figure 25:
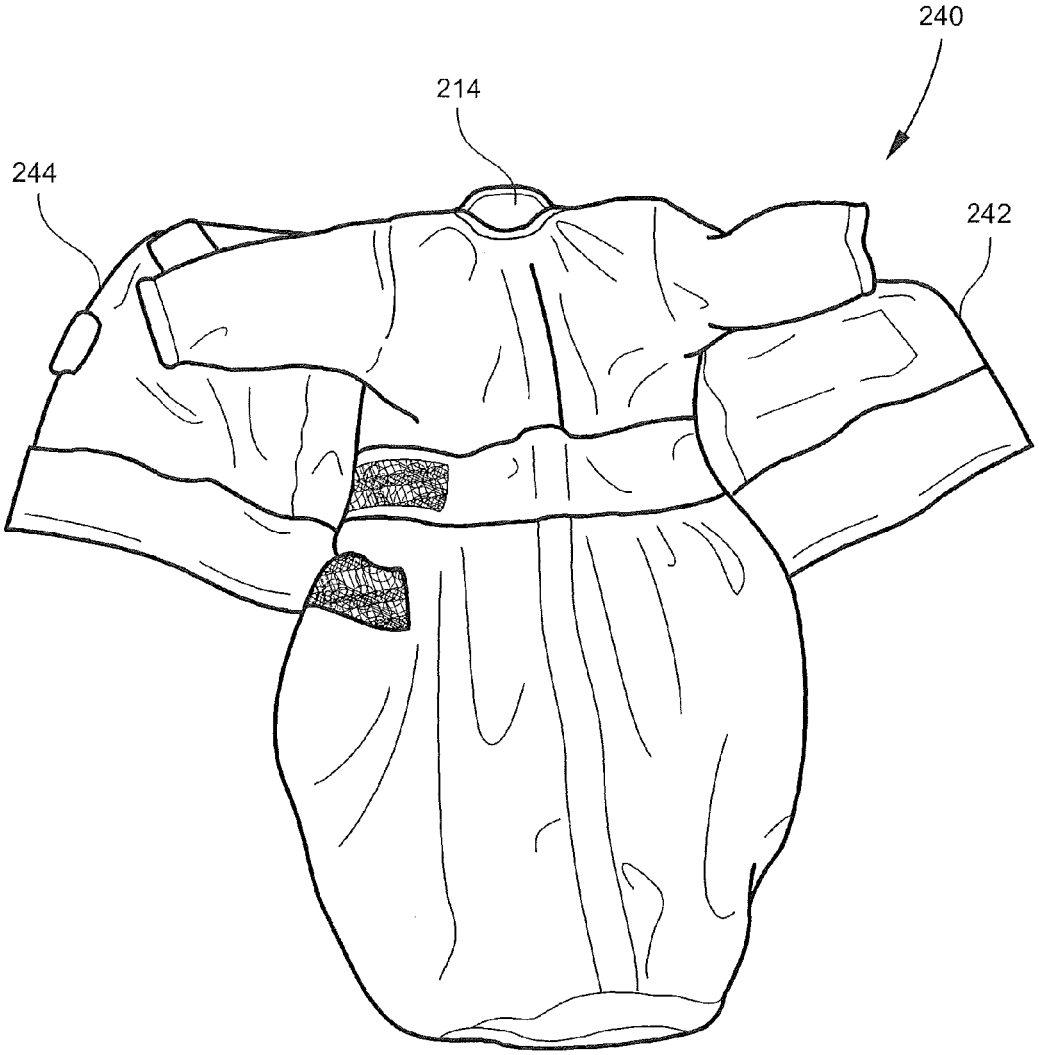
FIG. 25 is a front view of another embodiment of an infant garment including a long-sleeved dress and folding wings.
Figure 26:
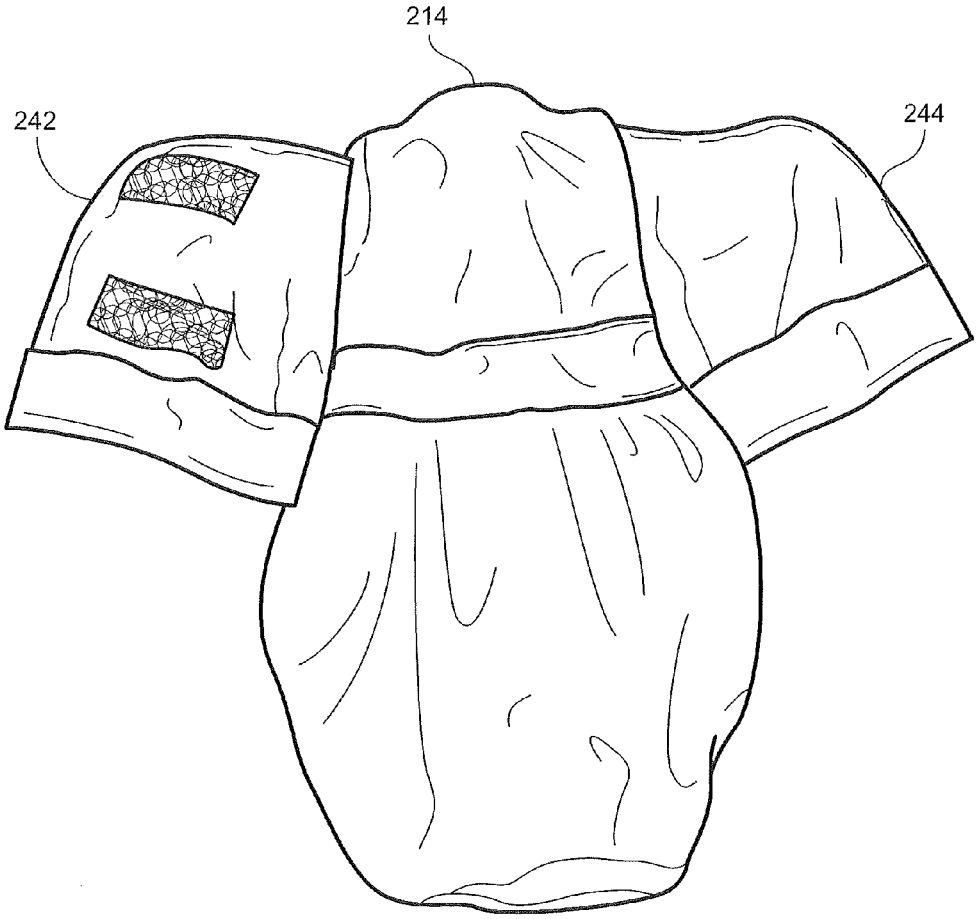
FIG. 26 is a back view of the garment of FIG. 25.

Referring to FIGS. 25 and 26, another embodiment of a garment is shown generally at reference numeral 240. Garment 240 is a long-sleeved dress with a closed foot end and includes wings 242, 244 that fold over the top half of the dress. The dress is thus the primary restraint and the winds are the secondary restraint. The wings 242, 244 fasten over the folded arms using hook-and-loop fasteners as described above. The garment 240 may include the same neck padding 214 as described above.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. An infant garment, comprising:

a body for covering an infant; and neck padding located within the body and extending from the base of the skull of an infant positioned on the body to the top of the shoulder blades of the infant positioned on the body, and partway from shoulder-to-shoulder of the infant positioned on the body; wherein:

the neck padding includes a greater degree of padding than the body; and the body is devoid of a head support portion.

2. The infant garment of claim 1, wherein the body is a sleeveless dress having a closed bottom and including a zipper for opening the dress.

3. The infant garment of claim 2, further including right and left wings that fold over one another over the dress.

4. The infant garment of claim 3, further comprising hook-and-loop fasteners for securing the right and left wings in a configuration folded over the dress.

5. The infant garment of claim 1, wherein the body is a kite-shaped body defining a body-supporting portion, a bottom flap and opposing right and left wings, wherein the bottom flap is configured to fold upward over the legs and torso of an infant, the right wing is configured to fold over the torso and the bottom flap, and the left wing is configured to fold over the torso and right wing.

6. The infant garment of claim 1, further comprising a plurality of hook-and-loop fasteners attached to the kite-shaped body at a plurality of positions for releasably engaging with other plurality of positions on the kite-shaped body.

7. The infant garment of claim 1, wherein the body is a long-sleeved dress including right and left wings that fold over a top half of the dress to restrain sleeves of the dress in a folded configuration.

8. The infant garment of claim 7, further comprising a plurality of hook-and-loop fasteners attached to the right and left wings at a plurality of positions for releasably engaging with other plurality of positions on the body.

9. The infant garment of claim 1, wherein the neck padding extends above shoulder portions of the body.

10. The infant garment of claim 1, wherein the neck padding has a convex polygon shape.

11. The infant garment of claim 1, wherein the body includes a primary restraint and a secondary restraint, wherein the primary restraint surrounds the infant and the secondary restraint surrounds the primary restraint.

12. An infant garment, comprising:

a primary restraint for covering an infant's body; and neck padding located within the primary restraint and extending from the base of the skull to the top of the shoulder blades of an infant positioned on the primary restraint, and partway from shoulder-to-shoulder of the infant positioned on the primary restraint; wherein:

the neck padding includes a greater degree of padding than the surrounding primary restraint, and the primary restraint is devoid of a head support portion.

13. The infant garment of claim 12, wherein the primary restraint is a sleeveless dress having a closed bottom.

14. The infant garment of claim 12, wherein the primary restraint is long-sleeved dress having a closed bottom.

15. The infant garment of claim 12, wherein the primary restraint is a kite-shaped wrap including a central portion, a bottom flap configured to fold in a direction of the central portion to form a form pocket, a right wing configured to fold over the central portion, and a left wing configured to fold over the central portion.

16. The infant garment of claim 12, wherein the neck padding extends above shoulder portions of the primary restraint.

17. The infant garment of claim 12, wherein the neck padding has a convex polygon shape.

* * * * *